US012523450B2

(12) United States Patent
Boydd

(10) Patent No.: US 12,523,450 B2
(45) Date of Patent: Jan. 13, 2026

(54) LOAD BEARING COVER FOR INTEGRATING A BOLT FREE BULLET PROOF PROTECTIVE SHIELD HAVING A DROP-DOWN SHIELD COVER EXPANSION KIT AND RIFLE SUPPORT BRACKET AND METHOD OF USE

(71) Applicant: James Boydd, Sherrills Ford, NC (US)

(72) Inventor: James Boydd, Sherrills Ford, NC (US)

(73) Assignee: Pinnacle Armor Company, Sheridan, WY (US)

( * ) Notice: Subject to any disclaimer, the term of this patent is extended or adjusted under 35 U.S.C. 154(b) by 0 days.

(21) Appl. No.: 18/928,820

(22) Filed: Oct. 28, 2024

(65) Prior Publication Data

US 2025/0052545 A1 Feb. 13, 2025

Related U.S. Application Data

(63) Continuation of application No. 17/401,488, filed on Aug. 13, 2021, now Pat. No. 12,152,863.

(51) Int. Cl.
*F41H 5/08* (2006.01)
*F41H 5/013* (2006.01)

(52) U.S. Cl.
CPC ..... *F41H 5/08* (2013.01); *F41H 5/013* (2013.01)

(58) Field of Classification Search
CPC ..... F41H 5/08; F41H 5/013; F41H 1/02
See application file for complete search history.

(56) References Cited

U.S. PATENT DOCUMENTS

| | | | | |
|---|---|---|---|---|
| 12,152,863 | B2 * | 11/2024 | Boydd | F41H 5/08 |
| 2016/0290770 | A1 * | 10/2016 | Martinez | F41H 5/08 |
| 2020/0166313 | A1 * | 5/2020 | Cigard | A41D 13/0002 |
| 2025/0257983 | A1 * | 8/2025 | Hall | F41H 5/08 |

* cited by examiner

*Primary Examiner* — J. Woodrow Eldred

(57) ABSTRACT

A portable bullet-proof shield comprising a load bearing shield cover for integrating a bolt free bullet resistant ballistic protective shield; said bullet resistant ballistic protective shield has no bolts, screws, or holes drilled into the ballistic protective shield, thereby not compromising the integrity of the shield; said load bearing shield cover has a high impact forearm padding, a forearm strap, and an integrated adjustable handle, which is intended to reduce fatigued and increase mobility of a user; one or more clips that are interwoven into said load bearing shield cover to provide clamping support for connecting a drop-down shield cover to said load bearing shield cover; said drop-down shield cover will provide further bullet proof protection beyond the size of said load bearing shield cover to then drop down and protect the lower area of a user's body, and a rifle support bracket having two connector pieces, a back connector piece which is interwoven into said load bearing shield cover and a front connector piece which is also interwoven into said load bearing shield cover and one or more screw to hold the two connect pieces together.

11 Claims, 21 Drawing Sheets

LOAD BEARING COVER FOR INTEGRATING A BOLT FREE BULLET PROOF PROTECTIVE SHIELD HAVING A DROP-DOWN SHIELD COVER EXPANSION KIT AND RIFLE SUPPORT BRACKET AND METHOD OF USE

CROSS-REFERENCE TO RELATED APPLICATIONS

The present application claims priority to U.S. patent application Ser. No. 17/401,488, titled "Load Bearing Shield Cover for Integrating a Bolt Free Bullet Proof Protective Shield having a Drop-Down Shield Cover Expansion Kit and Rifle Support Bracket and Method of Use," filed on Aug. 13, 2021, which is incorporated herein by reference in its entirety.

FIELD OF THE INVENTION

This invention relates in general to ballistic shields and more particularly to load bearing shield cover for intergrading a bolt free bullet resistant ballistic protective shield and rifle support bracket and method of use.

BACKGROUND OF THE INVENTION

Man-portable ballistic shields are frequently used by SWAT teams, bomb squads, police officers, military agencies, and in civilian applications that may involve ballistic impact due to operations related gun fire. Weight is a major consideration in the design of such portable shields. Most currently available ballistic shields are designed to defeat NIJ Level IIIA (pistol) and III (rifle) rounds.

Conventional portable shields are manufactured from metal sheets including but not limited to titanium, stainless steel, carbon steel, and superalloys. More modern ballistic shields are manufactured form ballistic resistant fabrics like aramid fibers and ceramic tiles.

Man-portable shields have been used since ancient times. Our ancestors used shields to protect from stone attacks. Later, shields were used for protection from arrows attack, swords, axes, spears, and other traditional weapons. Ballistic shields evolved with the invention of guns. Ballistic shield research and development, and improvements therein have evolved in parallel with the development of offensive weapons such as small arms. Man-portable ballistic shields for NIJ Level III protection appeared when rifles were developed. The typical state-of-the-art ballistic shield for NIJ Level III protection with dimensions of 20.5-in by 34.5-in weighs about 32-lb (for example those available from Protech).

A ballistic shield or tactical shield is a hand-held shield that is capable of defending the user from handgun, shotgun, and rifle ammunition. They are typically used by law enforcement or military during dangerous life or death situations. The average shield weighs at least about 20 to 40 pounds and is held by a user for a minimum time of 15 to 20 minutes. During this duration of time, it is often difficult to hold the shield in a protective upright position without experiencing fatigue and discomfort from supporting the weight of the shield. Being fatigued and discomfort may cause the user to be more vulnerable in a dangerous situation. This fatigue and discomfort may cause the user to lower the shield, pass the shield to a partner, or discard the shield which increases the risk to the user by exposing them to a potential deadly threat from firearms.

As such, there is a need in the art to develop a new compact and light weight shield (9 lb and 12 lb Ballistic Panel) that will severely increase the user's mobility and agility.

Additionally, there is a need in the art to create a new load bearing shield cover for integrating a bolt free bullet resistant protective shield.

As such, there is a need in the art for a new load bearing shield cover to fully support the weight of the bolt free bullet resistant protective shield panel. This cover is specifically designed to be durable and resilient, made in the USA from 1000 Denier Nylon with Mil-Spec webbing and stitching. The shield cover features front padding, Molle webbing, high impact forearm padding, forearm strap, and integrated adjustable handle. The cover can be customized by mounting various pouches, equipment and accessories. The top loading YKK zipper system secures the ballistic panel in place and allows for panel or cover swap if desired.

Law enforcement agencies, particularly Patrol Officers, are often called upon as first responders to confront armed and dangerous individuals. It is not uncommon for these agencies to be facing threats from pistol, rifle or even shotgun blasts. Additionally, in an "active shooter" situation where lives are being lost, responding law enforcement has very little time to prepare or assess the situation. Historically, active shooter situations are over in less than 5 minutes.

Although it is standard practice for law enforcement to wear soft body armor and police identification, typically when officers are called upon to stop an active shooter, they may not have the time to put on additional external body armor rated higher than their soft body armor. Tragically, any delay in response usually results in more casualties. There is always a tradeoff between speed and protection. Without proper protection and/or identification, these officers are vulnerable to hostile fire, as well as friendly fire. Furthermore, it should be understood that modern police practices include training where the solo officer is expected to respond and engage the deadly threat without waiting for backup officers to arrive. This practice is intended to interrupt the killing and draw the killer's attention to the responding officer.

For additional protection (to wearing personal body armor), personal shields may be employed. Shields provide an additional layer of protection and angles of protection not attainable from soft body armor or external body worn armor. With currently available shields, manipulating a weapon is severely limited because at least one of the officer's hands is occupied carrying the shield. Ballistic rated shields are heavy and generally rectangular in shape. This hinders the ability of the officer to travel long distances due to the shield weight (approximately 30+pounds) and to accurately aim a weapon and take a selective shot while on the move in a critical incident (especially in a crowded environment).

In the confusion of active shooter situations, where multiple agencies may be responding, including but not limited to, police, SWAT, plainclothes police officers and even gun carrying civilians, it is paramount that the police officers are easily identified. Identification of officers can help to avoid friendly fire mishaps.

It has been determined that in active shooter situations, if the responding police can draw the attention of the active shooter away from the victims toward themselves, this action saves lives. For this reason, it has also been considered important to identify officers so that the active shooter's attention might be diverted to the identifiable officer.

Accordingly, a need exists for a new system and method for protecting first responders that addresses one or more of these issues. Specifically, a new system and method is needed that is light-weight, rapidly deployable, identifies the user, and provides ballistic protection for first responders. Such systems and methods are disclosed herein.

This invention was originally designed for solo officer responses to active shooter incidents, this lightweight and compact shield can be quickly deployed from the front seat of a patrol vehicle for a variety of response options. Where time is critical and immediate engagement of a lethal threat is necessary to interrupt and stop the killing, Boydd's Compact Response Shield (CRS) can provide the first responder with a high degree of confidence by expanding the degree of ballistic protection, and by providing added coverage at angles not obtainable from standard plate carriers alone. This shield allows for excellent and accurate use of both rifle and pistol weapon platforms. In addition, the molle, Velcro and D-rings on the load bearing shield cover allow for the attachment of accessories such as medical kits, tourniquets, lights, slings, ammo pouches, etc. Additionally, the type of officer (K9, SHERIFF, US MARSHAL, POLICE, ECT.) can be identified on the front of the shield for quick identification. Due to its modular design, two shields can be connected at the bottom D-rings (one inverted) to provide more cover if desired.

As such, there is a need in the art for a new state-of-the-art-shield that is much lighter and practically applied in critical incidents. In addition, a bullet resistant shield that has no bolts, screws, or holes drilled into the ballistic shield increases the integrity of the armor by not compromising the shield's materials or construction in order to mount hardware into the panel itself.

The Rifle Support Bracket has been designed specifically for mounted to the front Molle of the cover and can be placed on either the left or right side depending on the user and his/her shooting preference. A rifle support bracket creates a more stable platform for accurate shot placement, fatigue reduction, and weapon manipulation. The support bracket is large enough to accommodate most rifle fore-grips and creates a steady platform for shooting while still allowing for proper sight picture.

There is also a need in the art for a shield that has a rifle support bracket, which provides an area for resting a gun or rifle.

Additionally, there is a need in the art for a new drop down shield cover expansion kit that provides a bullet resistant protective side panel that can attached to the load bearing shield and provide further protection beyond the size of the original shield to now drop down and protect the lower area of shield user's body.

In addition to the above problems as discussed above, it is an object of this invention to solve those problems by improving officer safety, improving the safety of the public, and increasing effectiveness of the user when utilizing a lightweight compact shield without bolts, holes or screws, suspended in a load bearing shield cover allowing for the attachment of accessories (such as medical kits) and having a weapon support bracket to improve accuracy while performing public safety operations and responses to critical deadly incidents.

SUMMARY OF THE INVENTION

It is therefore a principal object of this invention to provide compact and lightweight ballistic shield protection for first responders.

The present invention relates to systems and methods that provides a light-weight cover for holding bullet resistant ballistic protective shield panels that have no bolts, screws, or holes drilled into the ballistic shield panel, thereby not compromising the integrity of the shield.

It is also an object of the invention to provide a load bearing shield cover that fully supports the weight of a bolt free bullet resistant ballistic protective shield panel including accessories and a rifle support bracket.

The present invention provides a support system that can house a ballistic shield or a riot shield, intended to reduce fatigued and increase mobility.

A further aspect of an embodiment of the invention features a rifle support bracket that attaches to the support system that provides additional support and stability when supporting the shield with one arm and operating a firearm in the other arm.

A further aspect of an embodiment of the invention features a rifle support bracket which affords the user the ability to cradle and rest the weight of the rifle upon it.

It is another object of this invention in various embodiments of the invention to feature the Molle, Velcro and D-rings on the load bearing shield cover allow for the attachment of accessories such as medical kits, tourniquets, lights, slings, ammo pouches, etc.

It is an object of this invention in various embodiments of the invention provided by its modular design that two shields can be connected at the bottom D-rings (one inverted) to provide more cover if desired.

It is still yet another object of this invention to provide a new drop down shield cover expansion kit that provides a bullet resistant insert for the drop down shield cover, so that the drop down cover can attached to the load bearing shield and provide further protection beyond the size of the original shield to now drop down and protect the lower area of shield user's body.

It is also an object of this invention to utilize one or more new novel clips that are interwoven into the load bearing shield cover to provide clamping support and help distribute the additional weight from the drop down shield cover expansion having the bullet resistant insert.

It is an object of this invention to utilize a dual release buckle on the load bearing shield cover to holds up the drop down shield cover when it is not expanded or in use.

It is an object of the invention for the load bearing shield cover to identify the type of officer (K9, SHEFFIF, US MARSHAL, POLICE, ECT.) on the front of the shield for quick identification and to prevent accidental shootings of fellow officers.

It is therefore an object of the present invention to provide a compact and lightweight portable ballistic shield offering NIJ Level III or IIIa protection.

It is another object of the present invention to provide such a ballistic shield that permits effective sight picture and situational awareness due to the shaped design of the shield without the intentional introduction of a viewport or hardware requiring holes or cutouts which compromises the shield's ballistic integrity.

It is yet another object of the present invention to provide such a ballistic shield that permits illumination through shield viewing in low light conditions without the intentional introduction of a lower threat level weakness in the shield.

It is an object of this invention to provide a load bearing shield cover for intergrading a bolt free bullet resistant ballistic shield having a rifle support bracket device that is easy to manufacture, reliable in operation, and relatively inexpensive to produce.

Additional aspects, objectives, features and advantages of the present invention will become apparent from the following description of the preferred embodiments with reference to the attached drawings.

In addition to the above objects, various other objects of this invention will be apparent from careful reading of this specification including the detailed description contained herein below.

BRIEF DESCRIPTION OF THE DRAWINGS

These as well as other features of the present invention will become more apparent upon reference to the accompanying drawings wherein like numerals designate corresponding parts in the several figures summarized as follows.

Other features and advantages of the invention will be become apparent from the following detailed description, taken in conjunction with the accompany drawings, which illustrate, by way of example, various features of the invention.

DETAILED DESCRIPTION OF THE PREFERRED EMBODIMENTS

The following detailed description and accompanying drawings are provided for purposes of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and the scope of the invention.

Referring to FIGS. 1-12 showing the invention, a load bearing shield cover having a bolt free bullet proof protective shield.

Referring to FIGS. 13-19, 24, and 25 showing the invention, a load bearing shield cover having a rifle support bracket being connected by interweaving the back portion of the rifle support bracket into the load bearing shield cover. The load bearing shield cover has a dual sided release buckle for holding up the drop down shield cover expansion, and a rifle support bracket mounted on both the left and right sides.

Referring to FIGS. 20-25 and 29-30 showing the invention, a load bearing shield cover having a drop down shield cover expansion. The drop down shield cover expansion kit has a bullet proof panel insert. The load bearing shield cover attached to the drop down shield cover expansion kit by using more than one novel clips that are interwoven into the load bearing shield cover and connected to the drop down shield cover. The load bearing shield cover has a dual sided release buckle for holding up the drop down shield cover. The load bearing shield cover has a dual sided release buckle, wherein said buckle can be released to engage the drop down shield cover expansion to provide further protection beyond the size of the original shield to now drop down and protect the lower area of a user's body.

Figure 1:
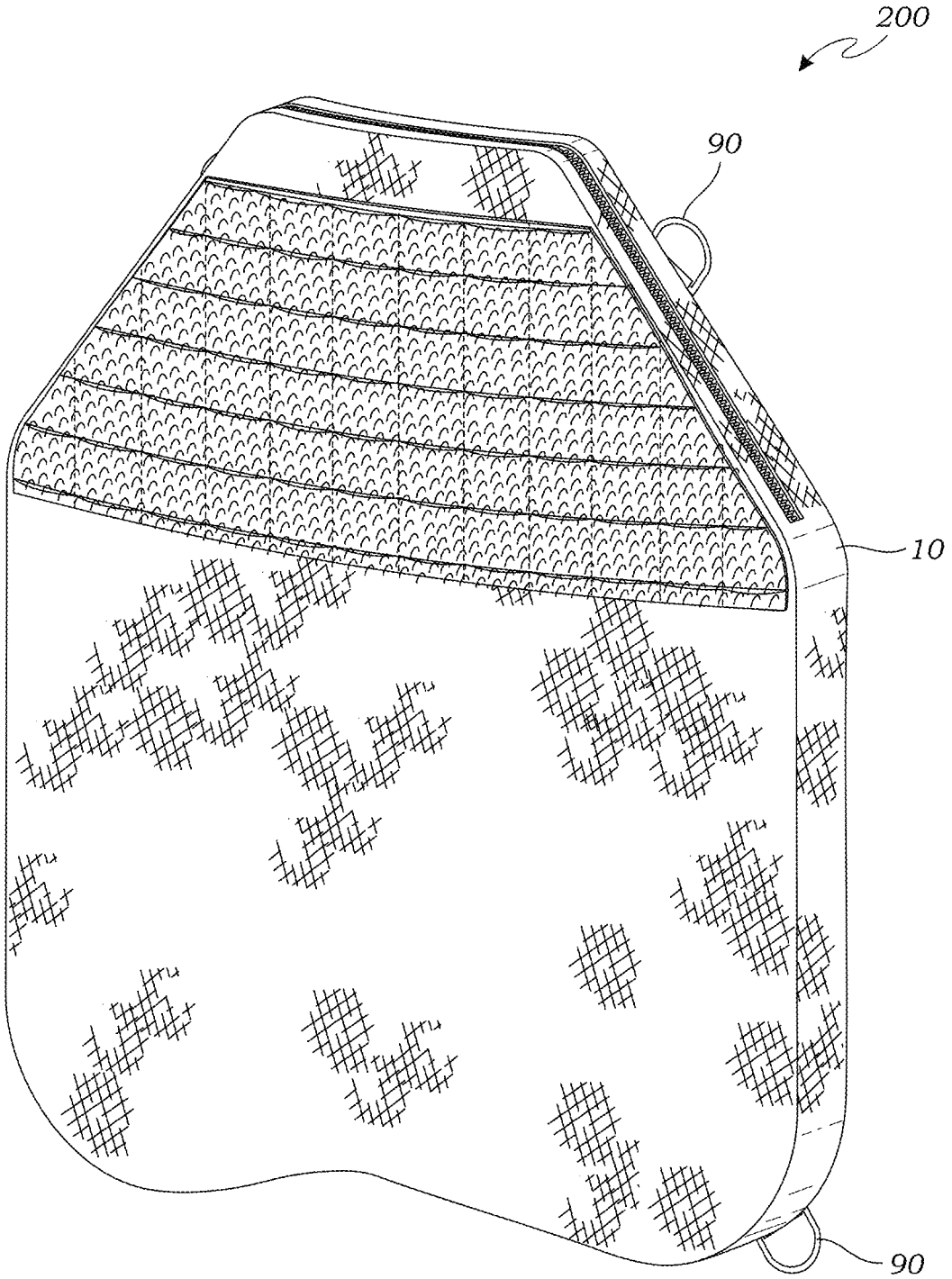
FIG. 1 is a perspective view of the LOAD BEARING SHIELD COVER.
Figure 3:
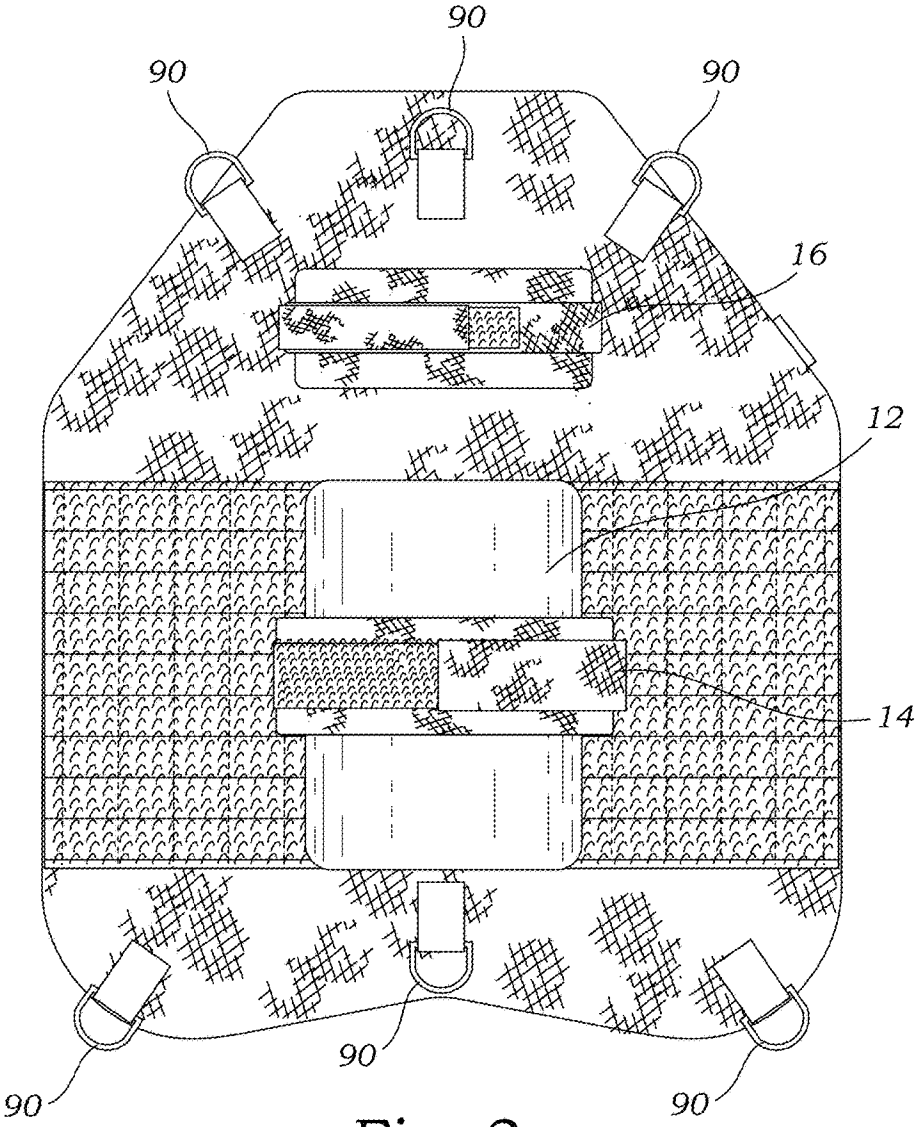
FIG. 3 is a back view of the LOAD BEARING SHIELD COVER.
Figure 2:
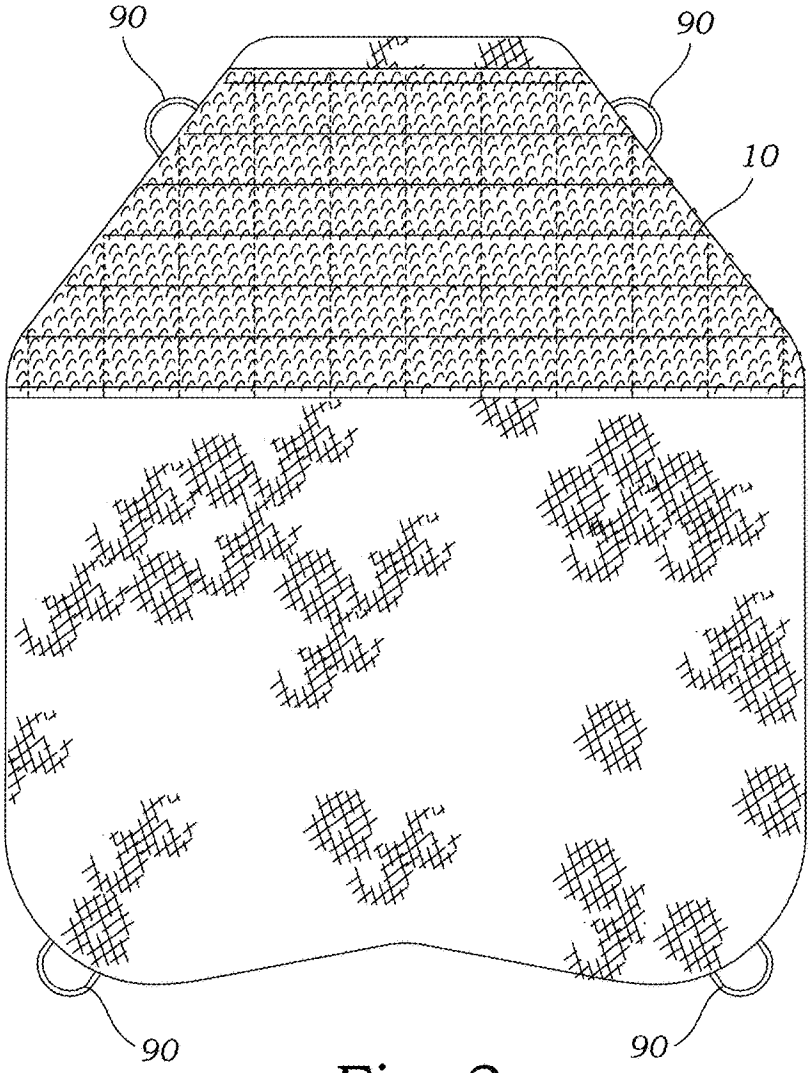
FIG. 2 is the front view of the LOAD BEARING SHIELD COVER.
Figure 4:
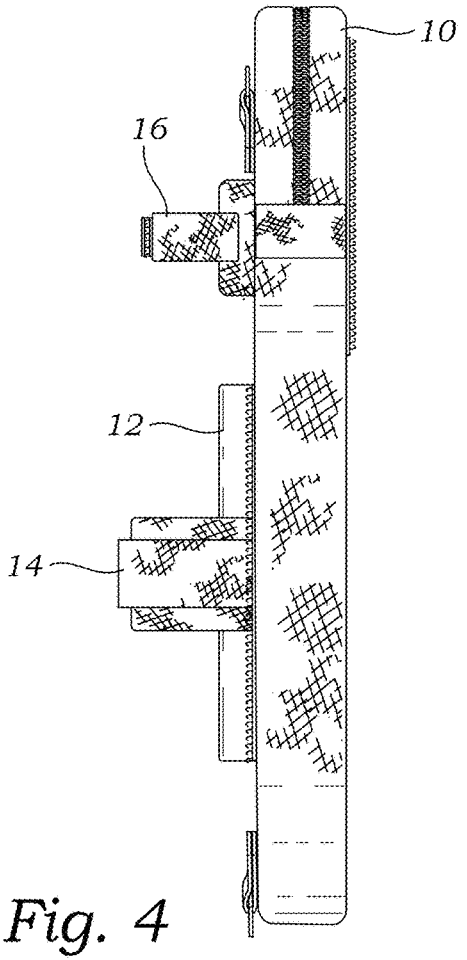
FIG. 4 is a side view of the LOAD BEARING SHIELD COVER.
Figure 5:
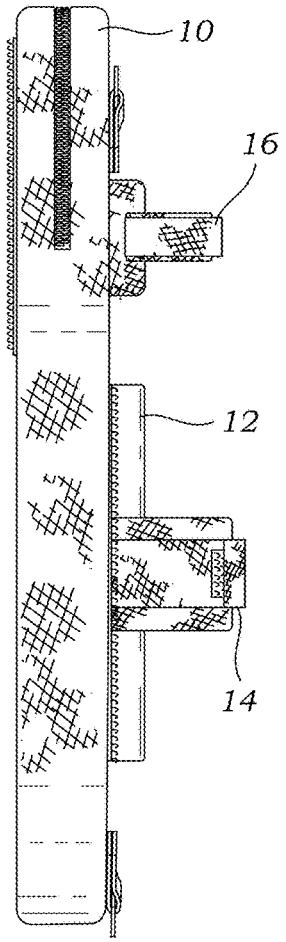
FIG. 5 is the other side view of the LOAD BEARING SHIELD COVER.
Figure 6:
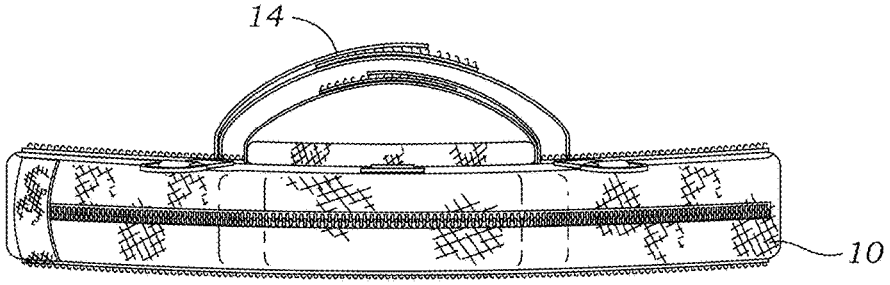
FIG. 6 is a top view of the LOAD BEARING SHIELD COVER.
Figure 7:
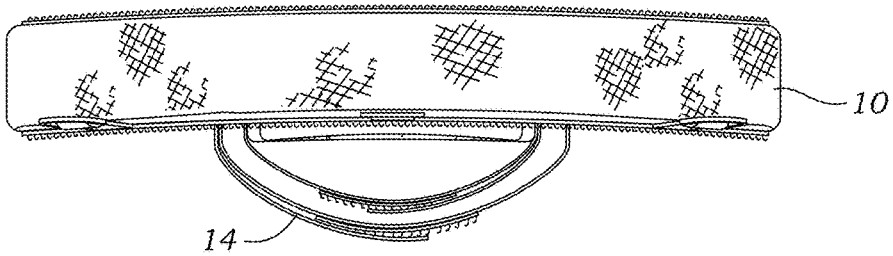
FIG. 7 is bottom view of the LOAD BEARING SHIELD COVER.
Figure 8:
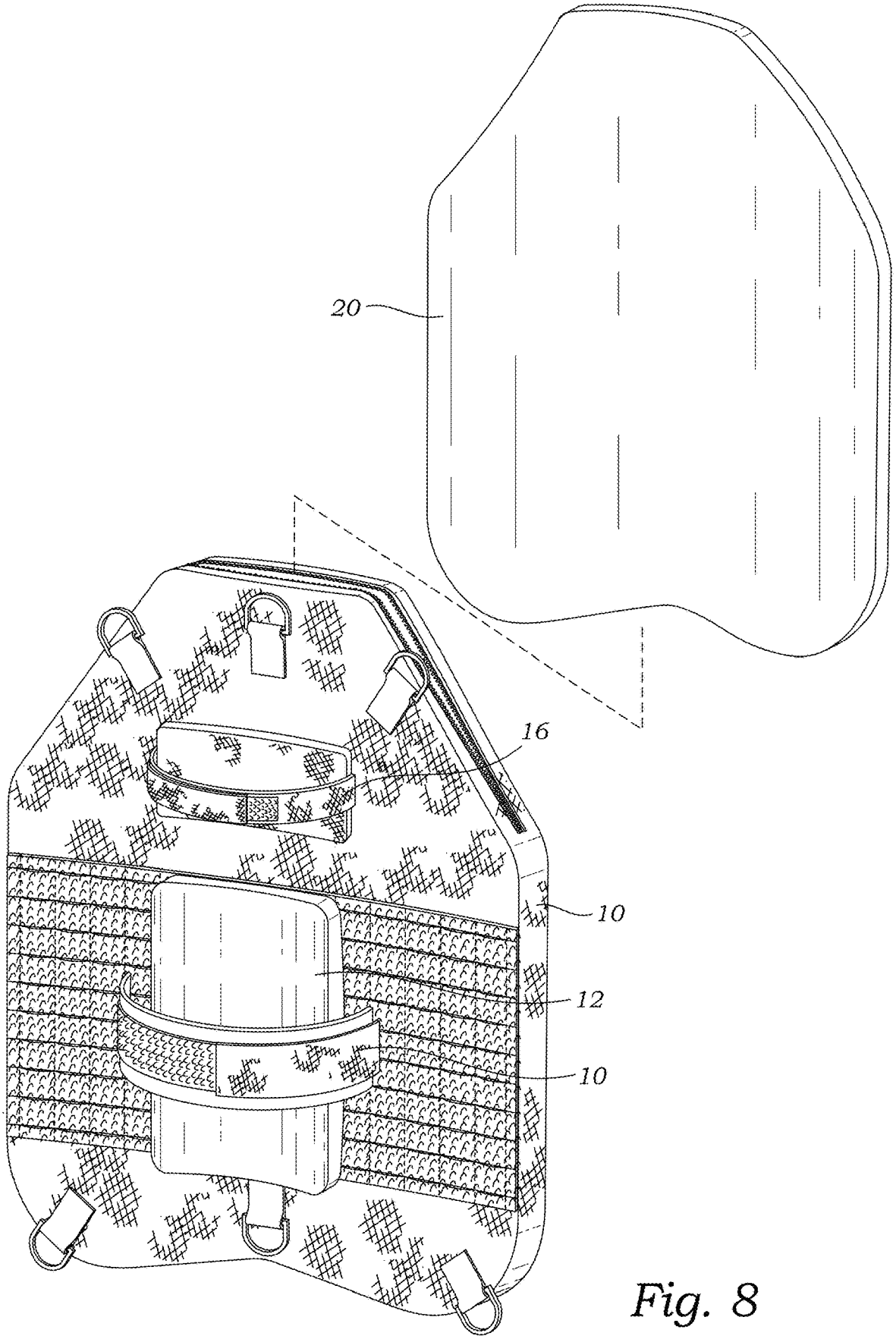
FIG. 8 is a perspective view of the LOAD BEARING SHIELD COVER showing the BOLT FREE BULLET PROOF PROTECTIVE SHIELD being inserted therein.
Figure 9:
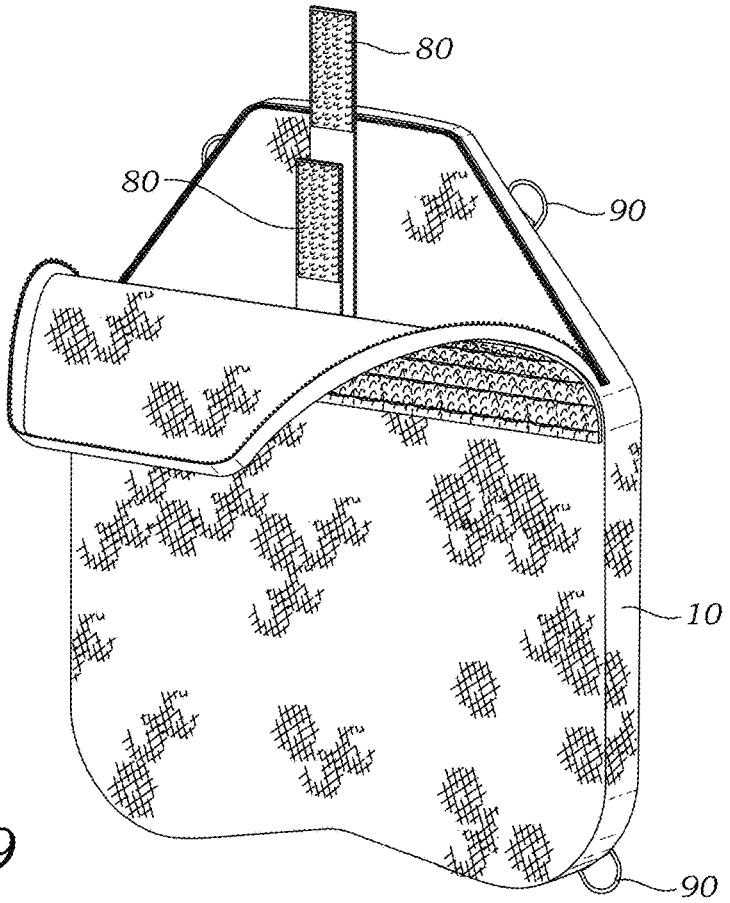
FIG. 9 is a perspective view of the LOAD BEARING SHIELD COVER showing the internal straps for securing the BOLT FREE BULLET PROOF PROTECTIVE SHIELD therein.
Figure 10:
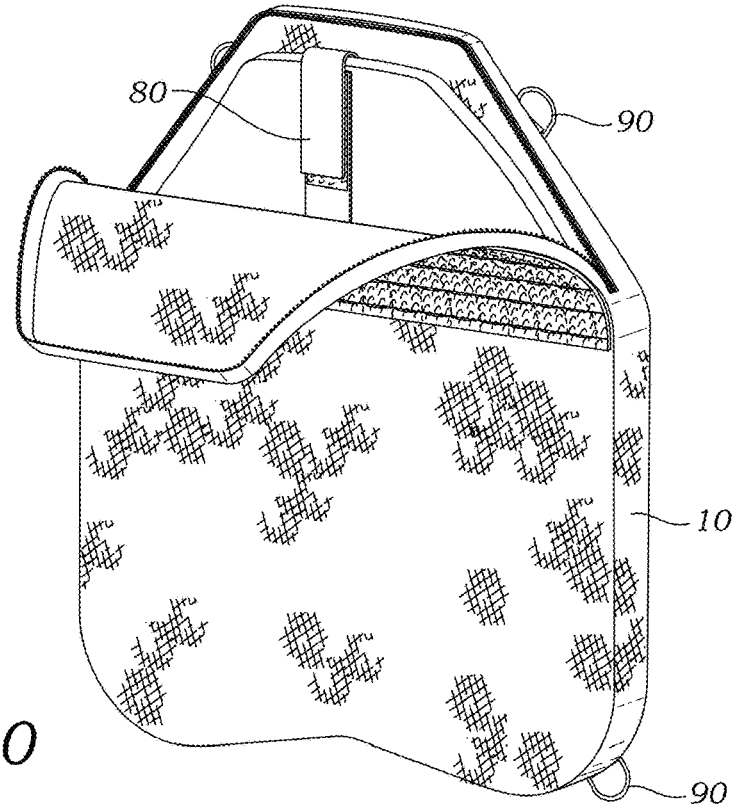
FIG. 10 is a perspective view of the LOAD BEARING SHIELD COVER showing the BOLT FREE BULLET PROOF PROTECTIVE SHIELD being internally strapped therein.
Figure 11:
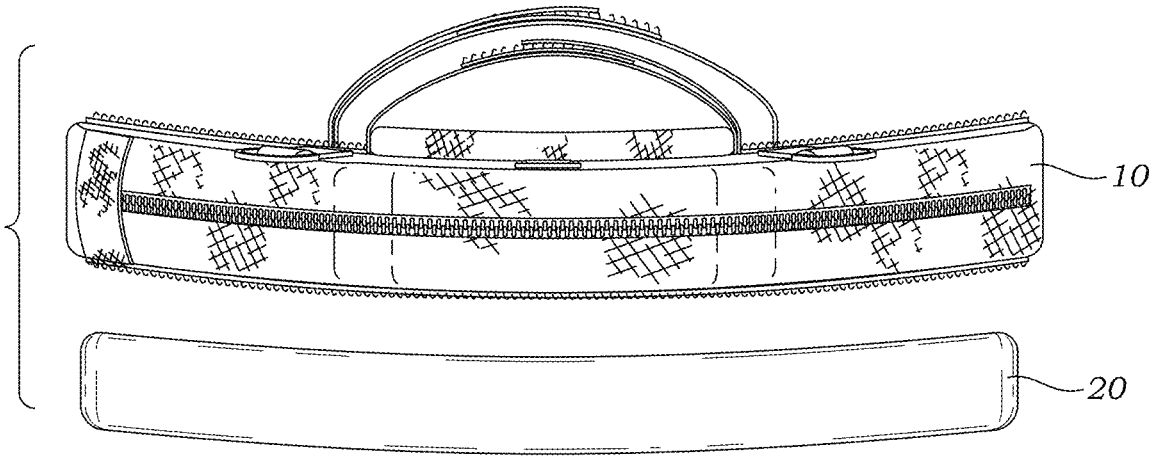
FIG. 11 is a top view of the LOAD BEARING SHIELD COVER and preferred embodiment of the BOLT FREE BULLET PROOF PROTECTIVE SHIELD having a curved design.
Figure 12:
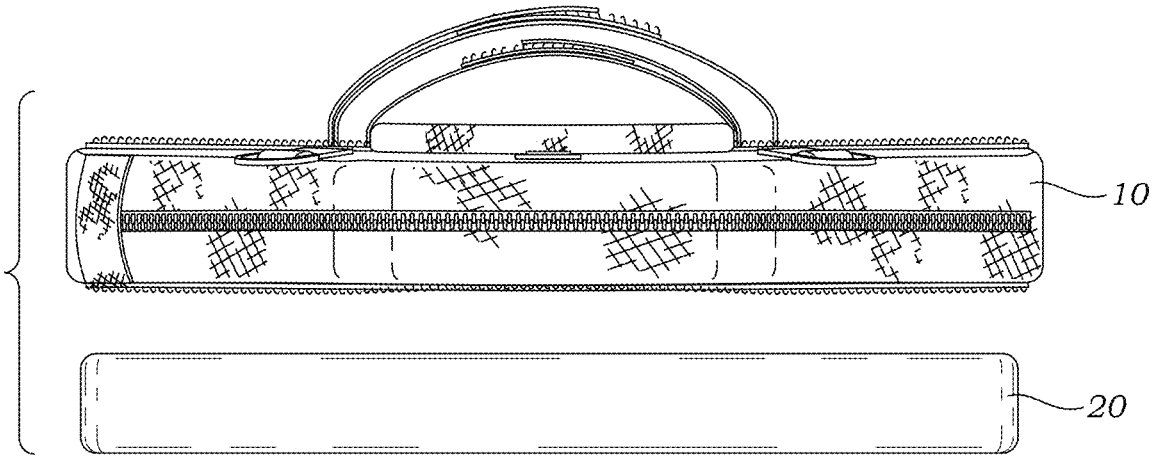
FIG. 12 is a top view of the LOAD BEARING SHIELD COVER and an alternative embodiment of the BOLT FREE BULLET PROOF PROTECTIVE SHIELD without a curved design.
Figure 13:
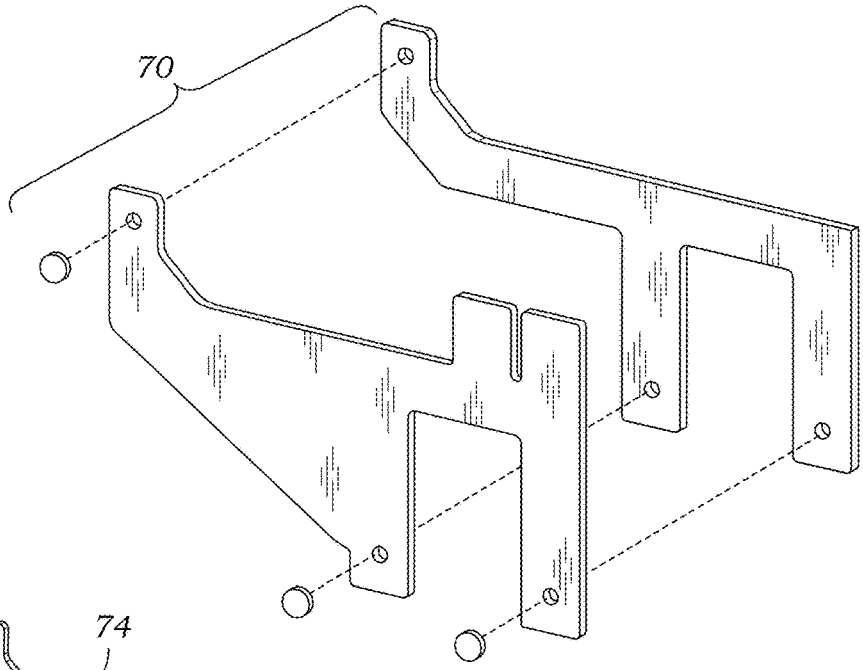
FIG. 13 is an exploded view of the RIFLE SUPPORT BRACKET.
Figure 14:
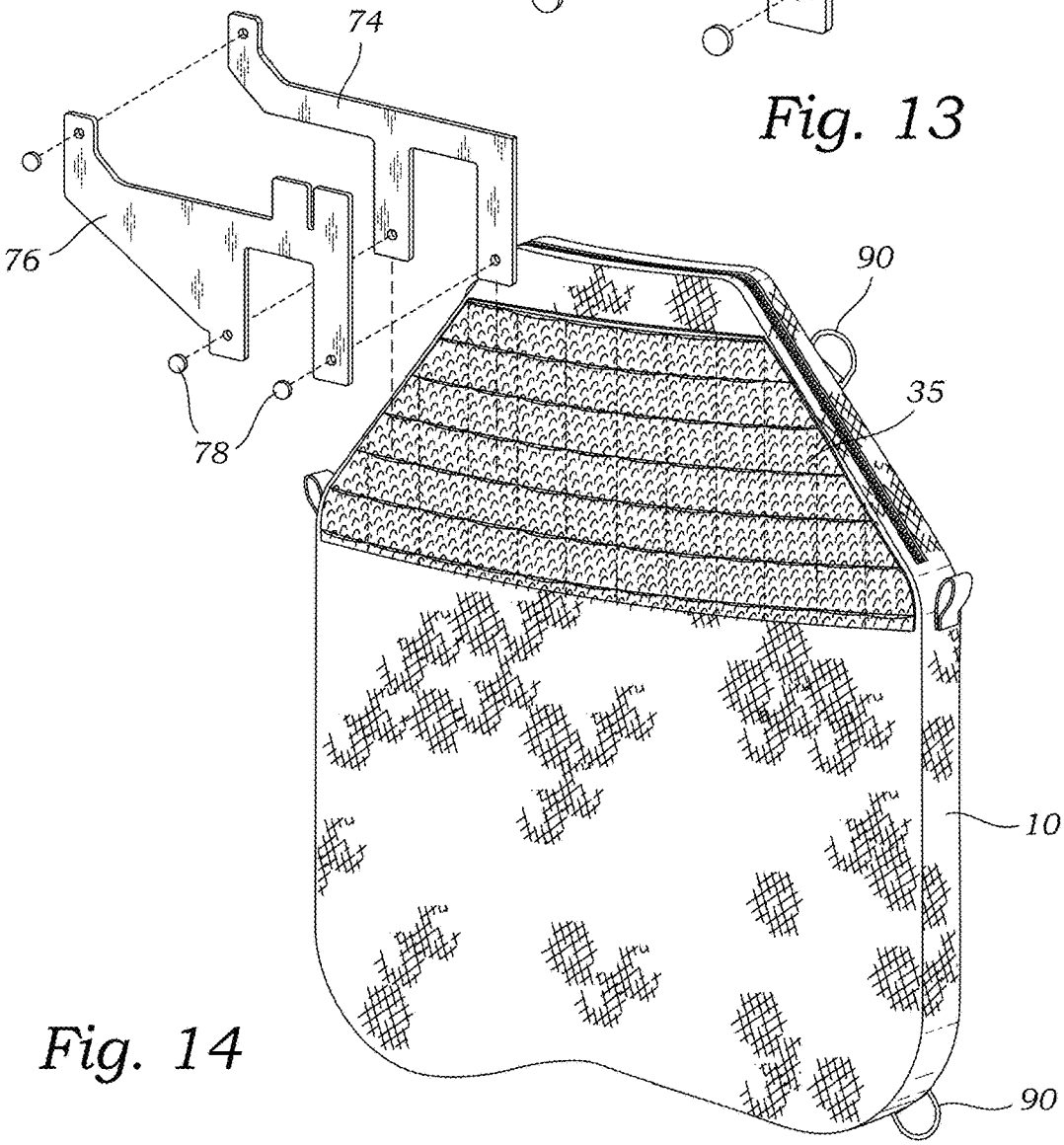
FIG. 14 is an exploded view of the RIFLE SUPPORT BRACKET showing where the RIFLE BRACKET is attached to the LOAD BEARING SHIELD COVER.
Figure 15:
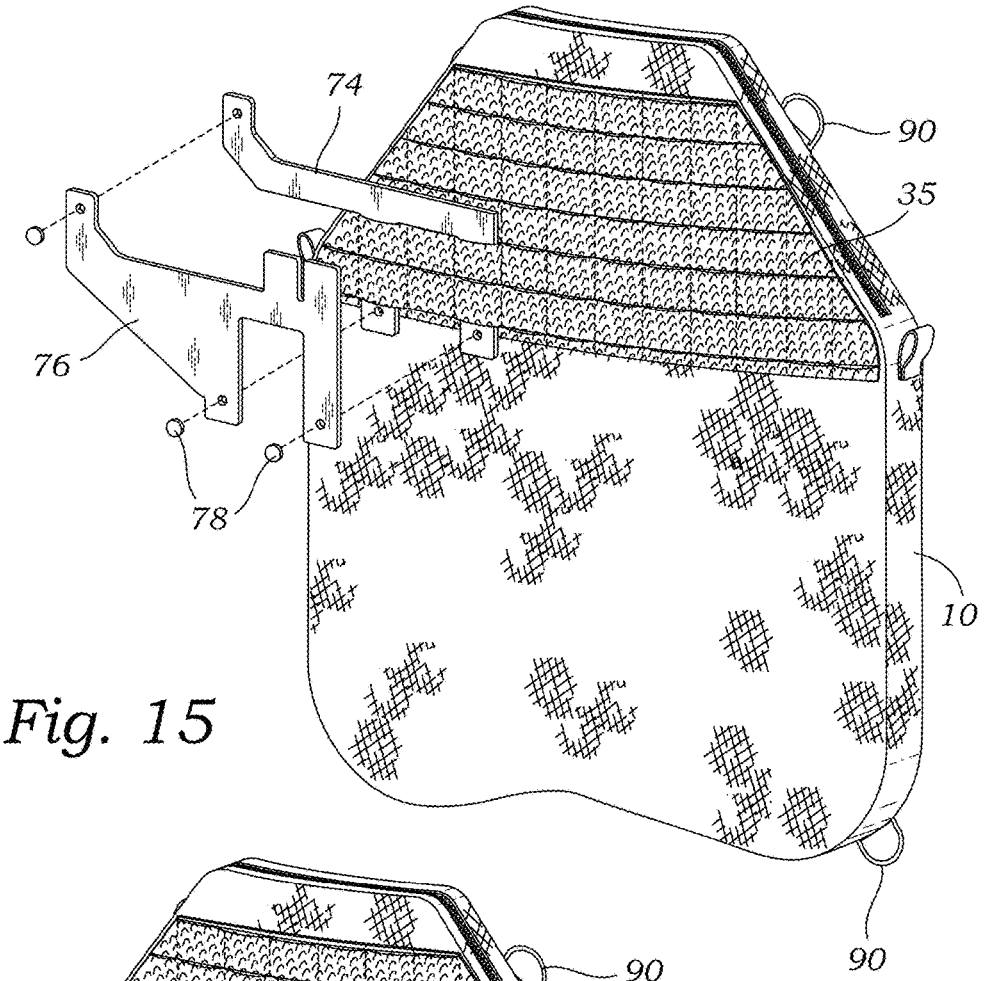
FIG. 15 is a partially connected and exploded view of the RIFLE SUPPORT BRACKET being connected by interweaving the back portion of the rifle support bracket into the LOAD BEARING SHIELD COVER.
Figure 16:
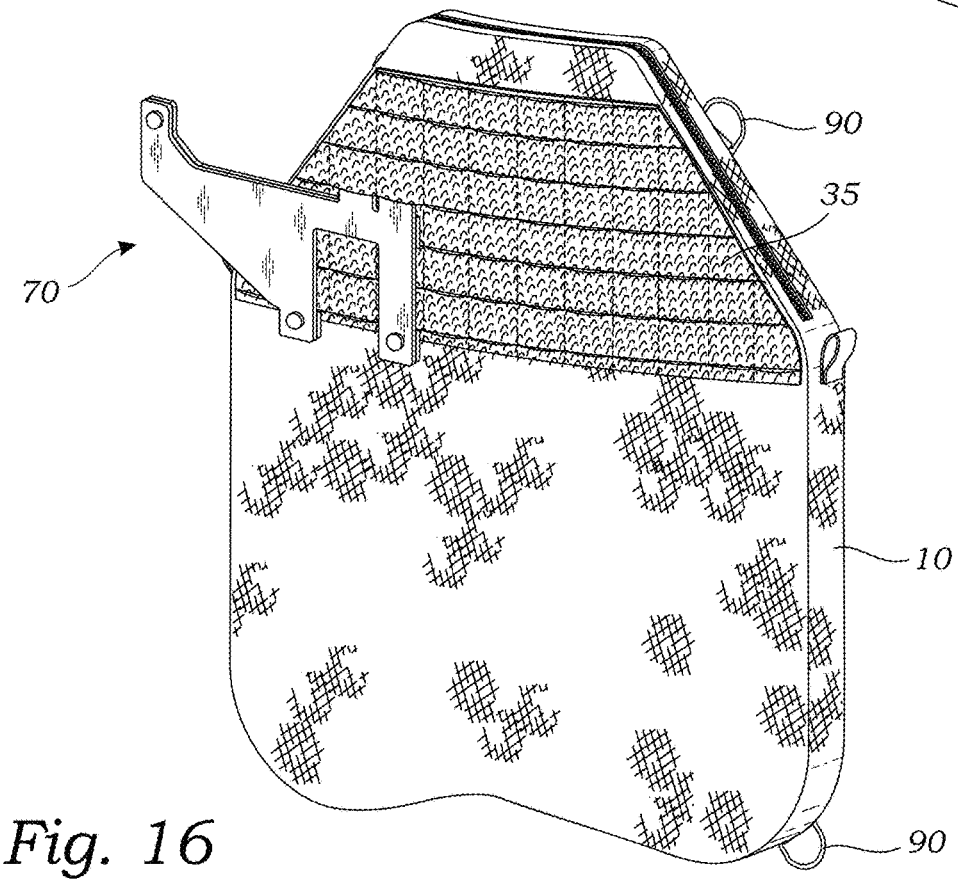
FIG. 16 is a perspective view of the LOAD BEARING SHIELD COVER having a BOLT FREE BULLET PROOF PROTECTIVE SHIELD being internally strapped therein with a RIFLE SUPPORT BRACKET.
Figure 17:
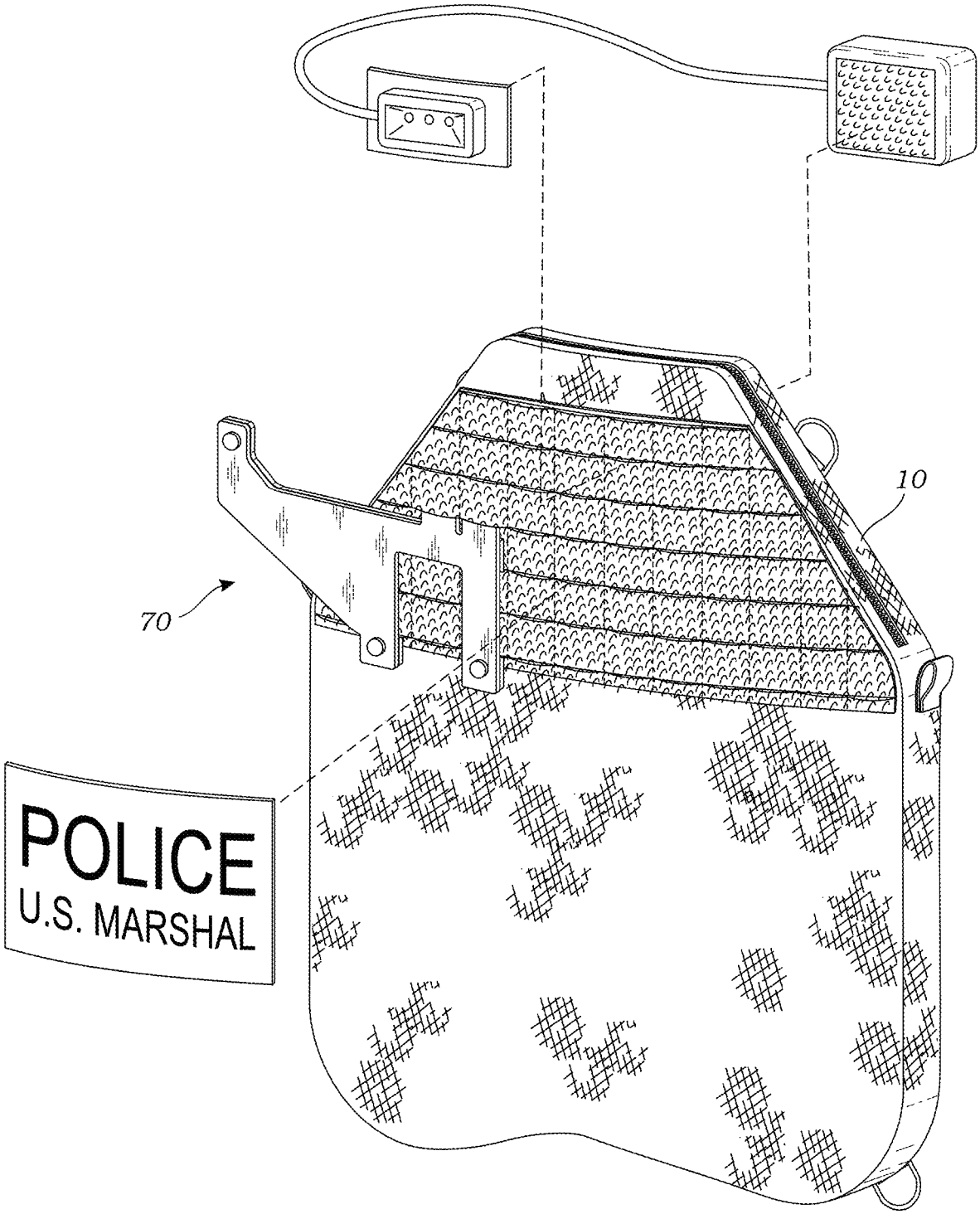
FIG. 17 is an perspective view of the LOAD BEARING SHIELD COVER having a BOLT FREE BULLET PROOF PROTECTIVE SHIELD being internally strapped therein with a RIFLE SUPPORT BRACKET and a removable light and police identification patch shown exploded.
Figure 18:
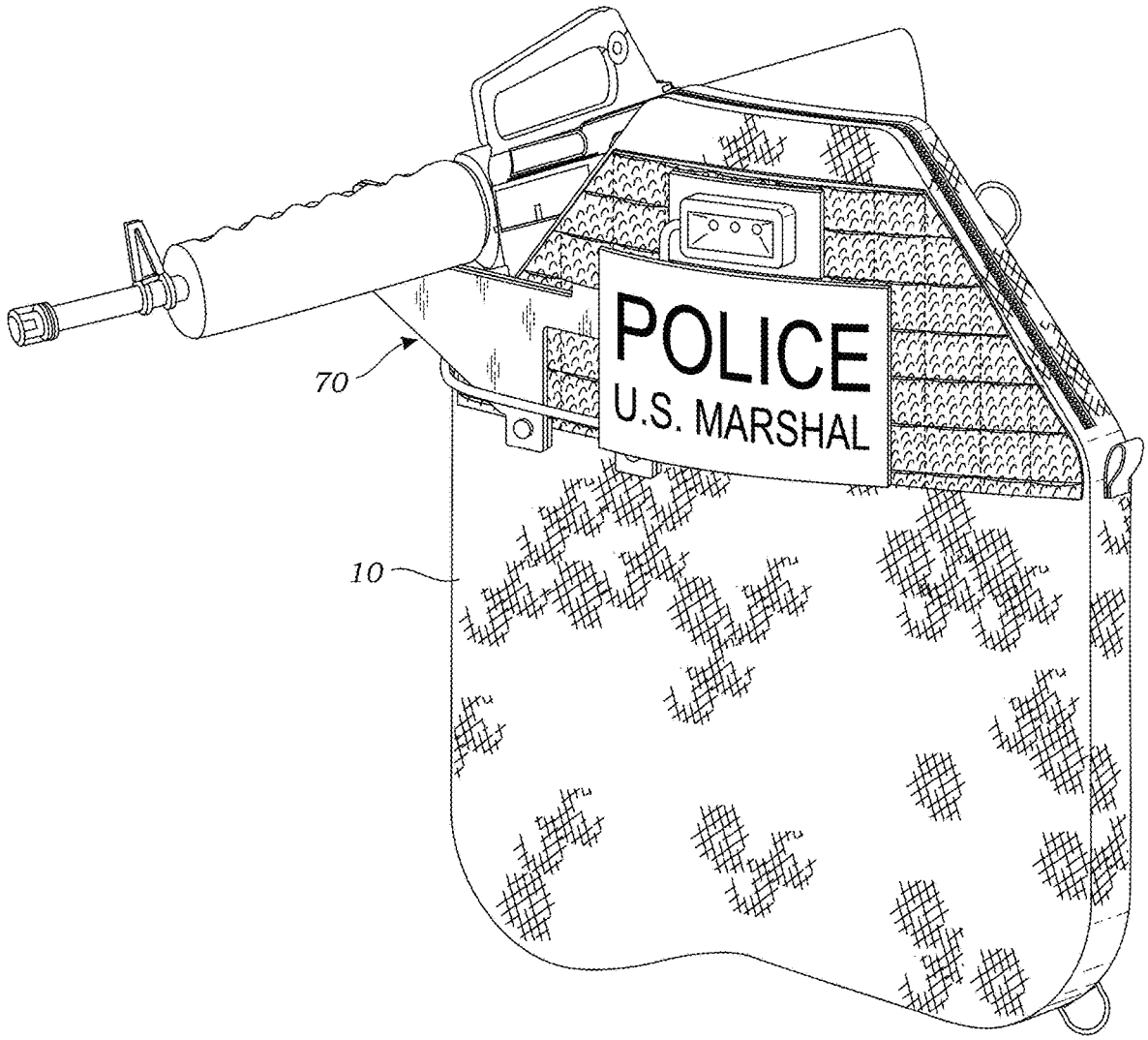
FIG. 18 is a perspective view of the LOAD BEARING SHIELD COVER having a BOLT FREE BULLET PROOF PROTECTIVE SHIELD being internally strapped therein with a RIFLE SUPPORT BRACKET and a light.
Figure 19:
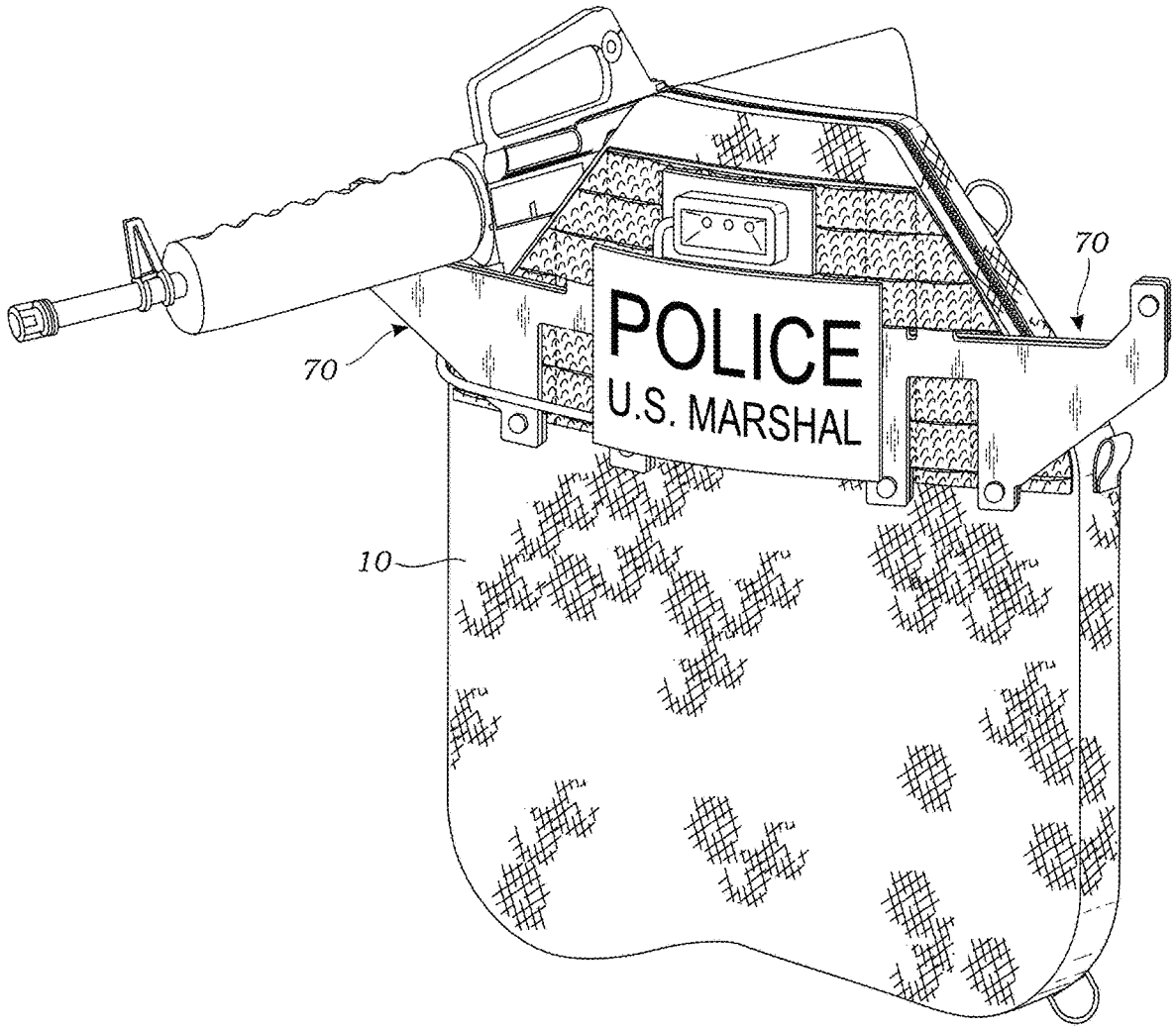
FIG. 19 is a perspective view of the LOAD BEARING SHIELD COVER having a BOLT FREE BULLET PROOF PROTECTIVE SHIELD being internally strapped therein with a RIFLE SUPPORT BRACKET MOUNTED on both the left and right sides, and a light.
Figure 20:
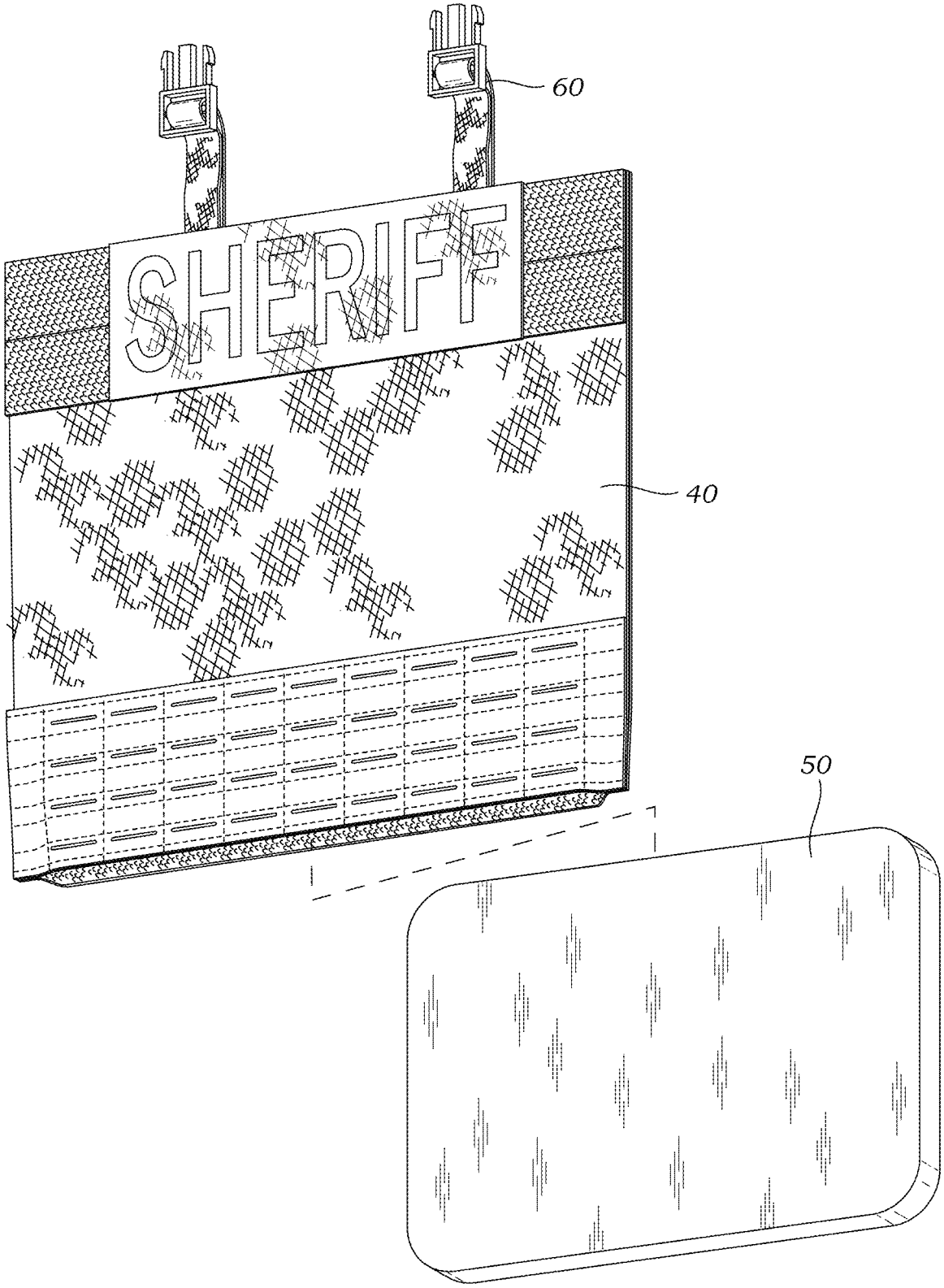
FIG. 20 is a perspective view of the DROP DOWN SHIELD COVER EXPANSION KIT having a bullet proof panel insert.
Figure 21:
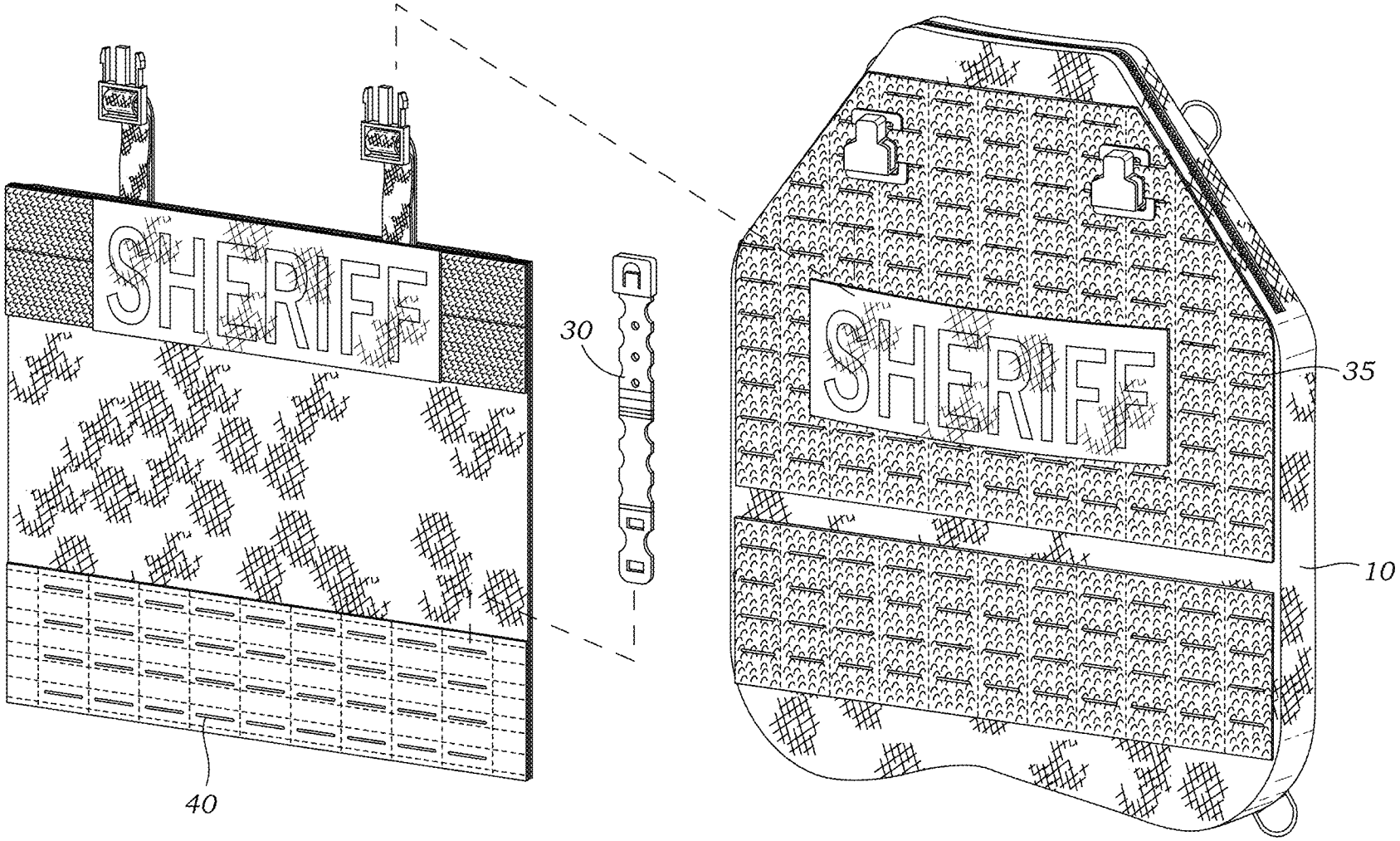
FIG. 21 is a perspective exploded view of the LOAD BEARING SHIELD COVER, DROP DOWN SHIELD COVER EXPANSION KIT, and novel clips that are interwoven into the load bearing shield cover to support the DROP DOWN SHIELD COVER and bullet proof panel insert.
Figure 22:
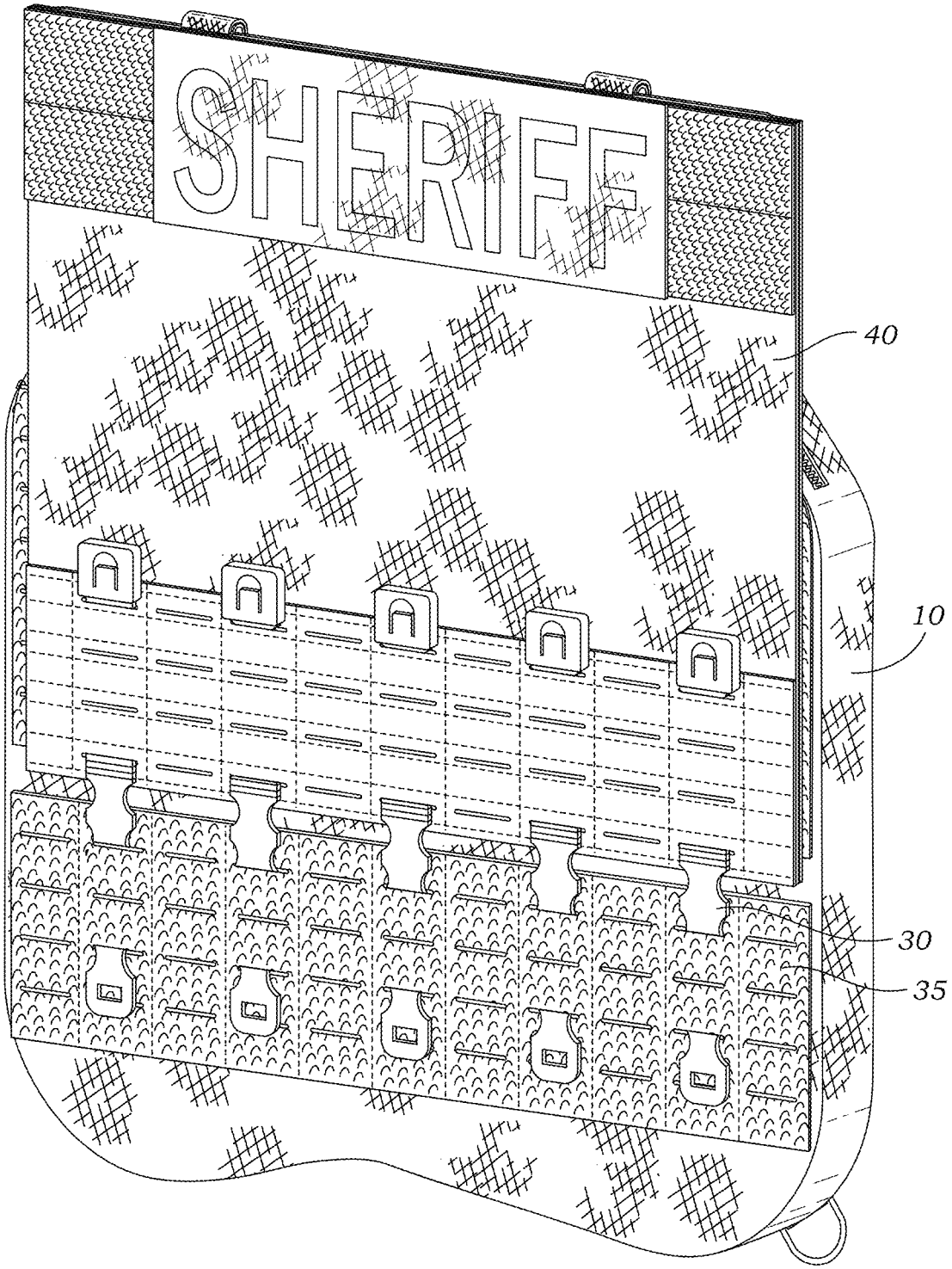
FIG. 22 is a perspective view of the LOAD BEARING SHIELD COVER attached to the DROP DOWN SHIELD COVER EXPANSION KIT by using more than one novel clips that are interwoven into the LOAD BEARING SHIELD COVER and connected to the DROP DOWN SHIELD COVER.
Figure 23:
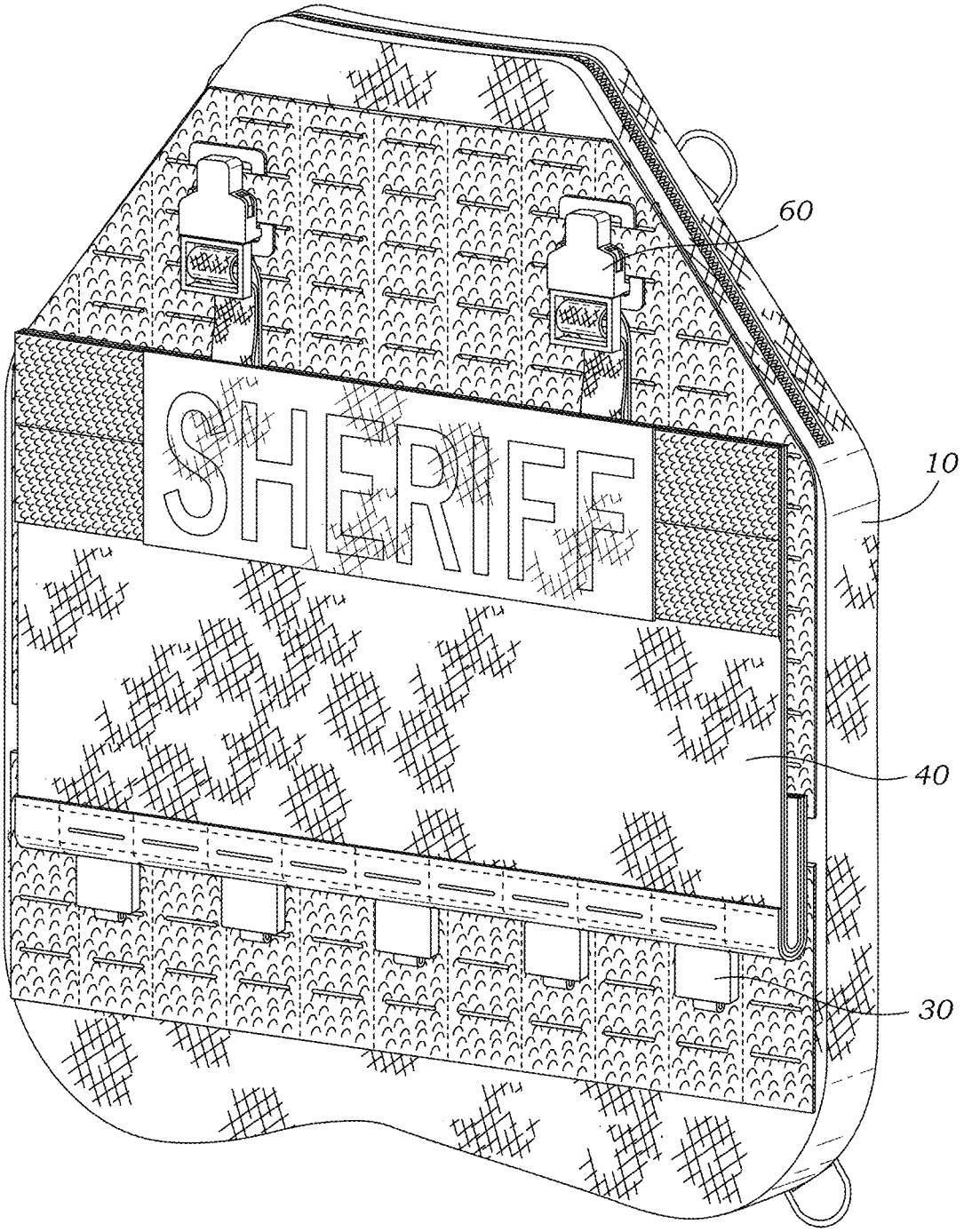
FIG. 23 is a perspective view of the LOAD BEARING SHIELD COVER having a dual sided release buckle for holding up the DROP DOWN SHIELD COVER EXPANSION when it is not expanded or in use.
Figure 24:
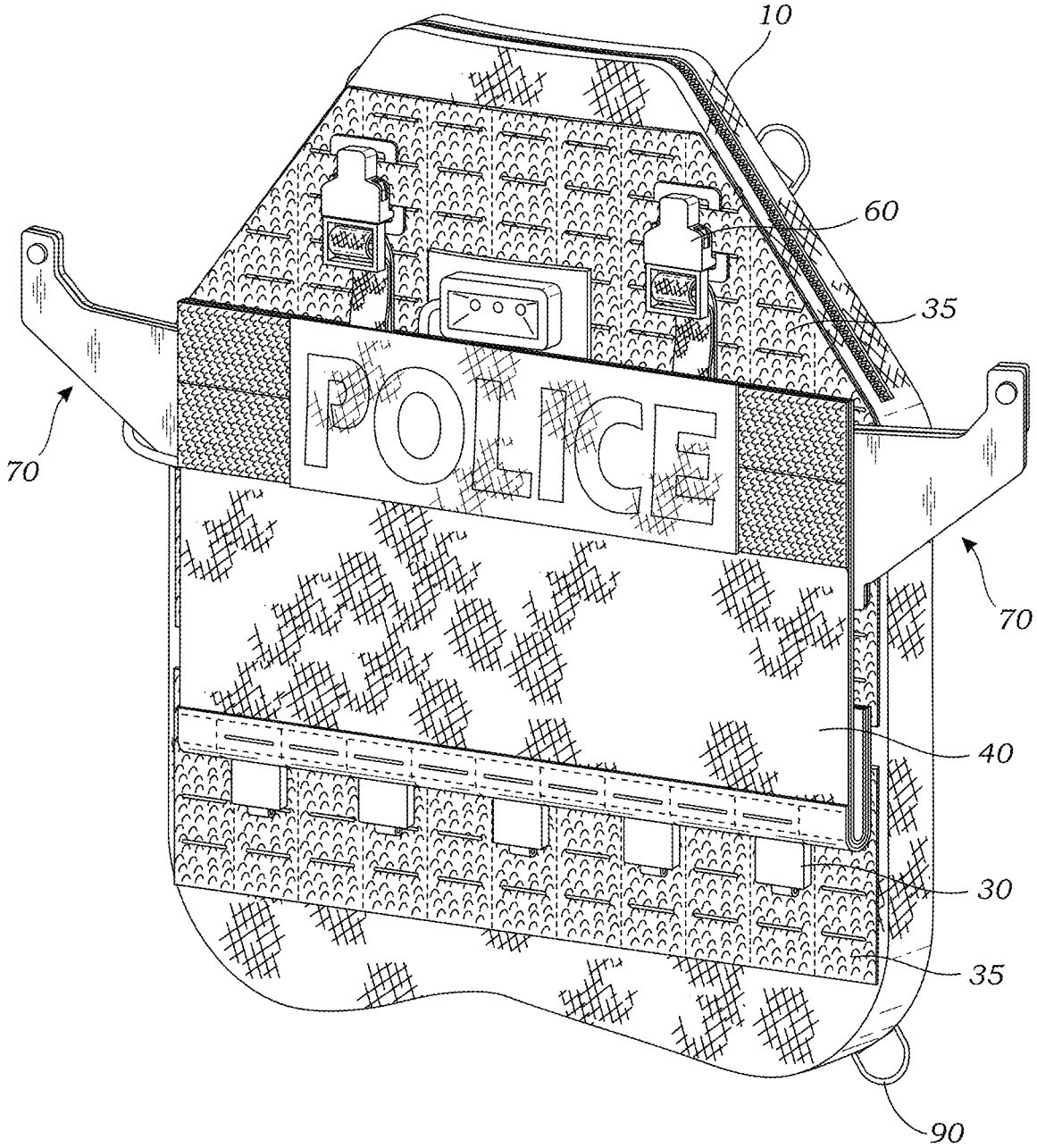
FIG. 24 is a perspective view of the LOAD BEARING SHIELD COVER having a dual sided release buckle for holding up the DROP DOWN SHIELD COVER EXPANSION, and A RIFLE SUPPORT BRACKET MOUNTED on both the left and right sides, and a light.
Figure 25:
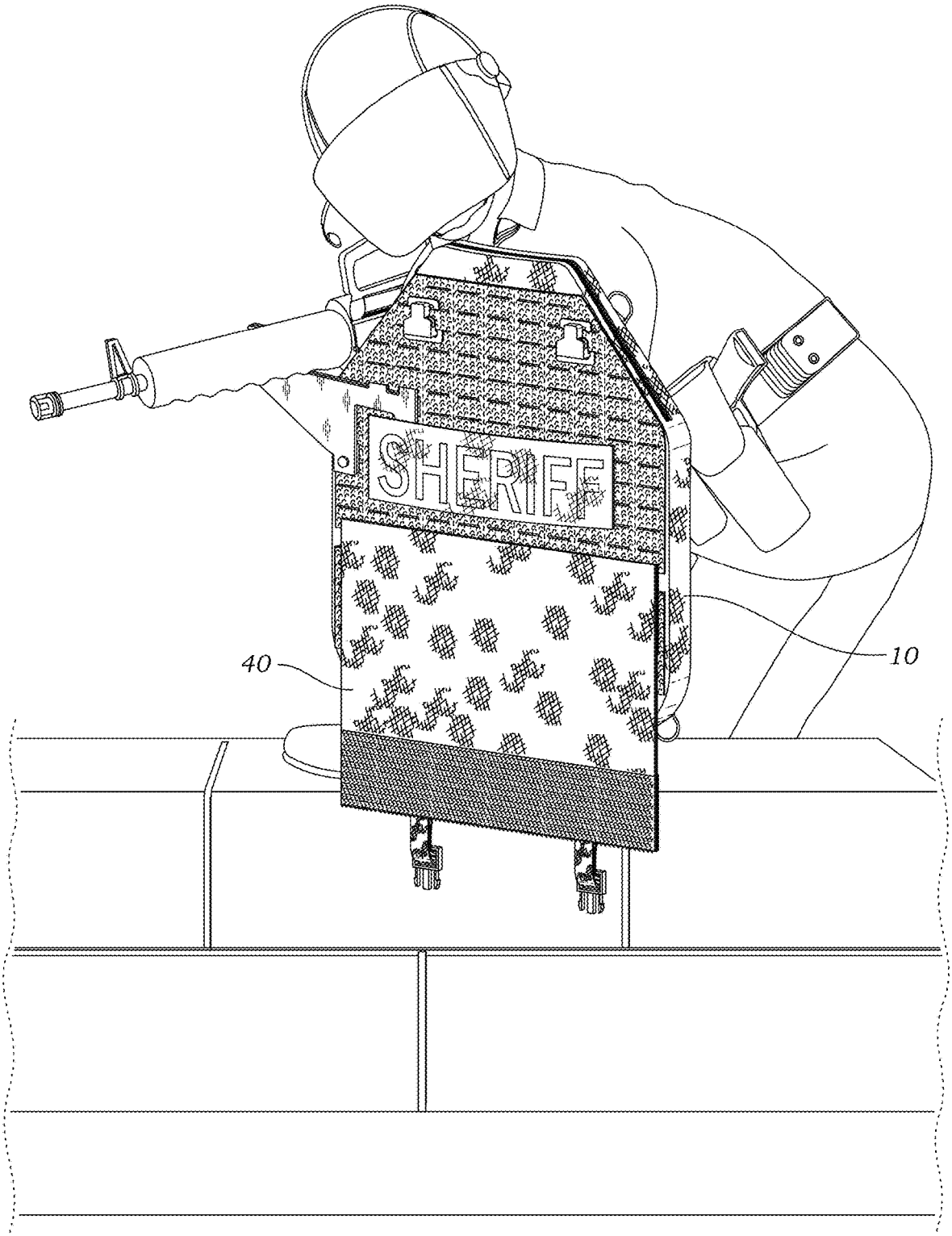
FIG. 25 is a perspective view of the LOAD BEARING SHIELD COVER having a dual sided release buckle, wherein said buckle has been released to engage the DROP DOWN SHIELD COVER EXPANSION to provide further protection beyond the size of the original shield to now drop down and protect the lower area of a user's body.
Figure 26:
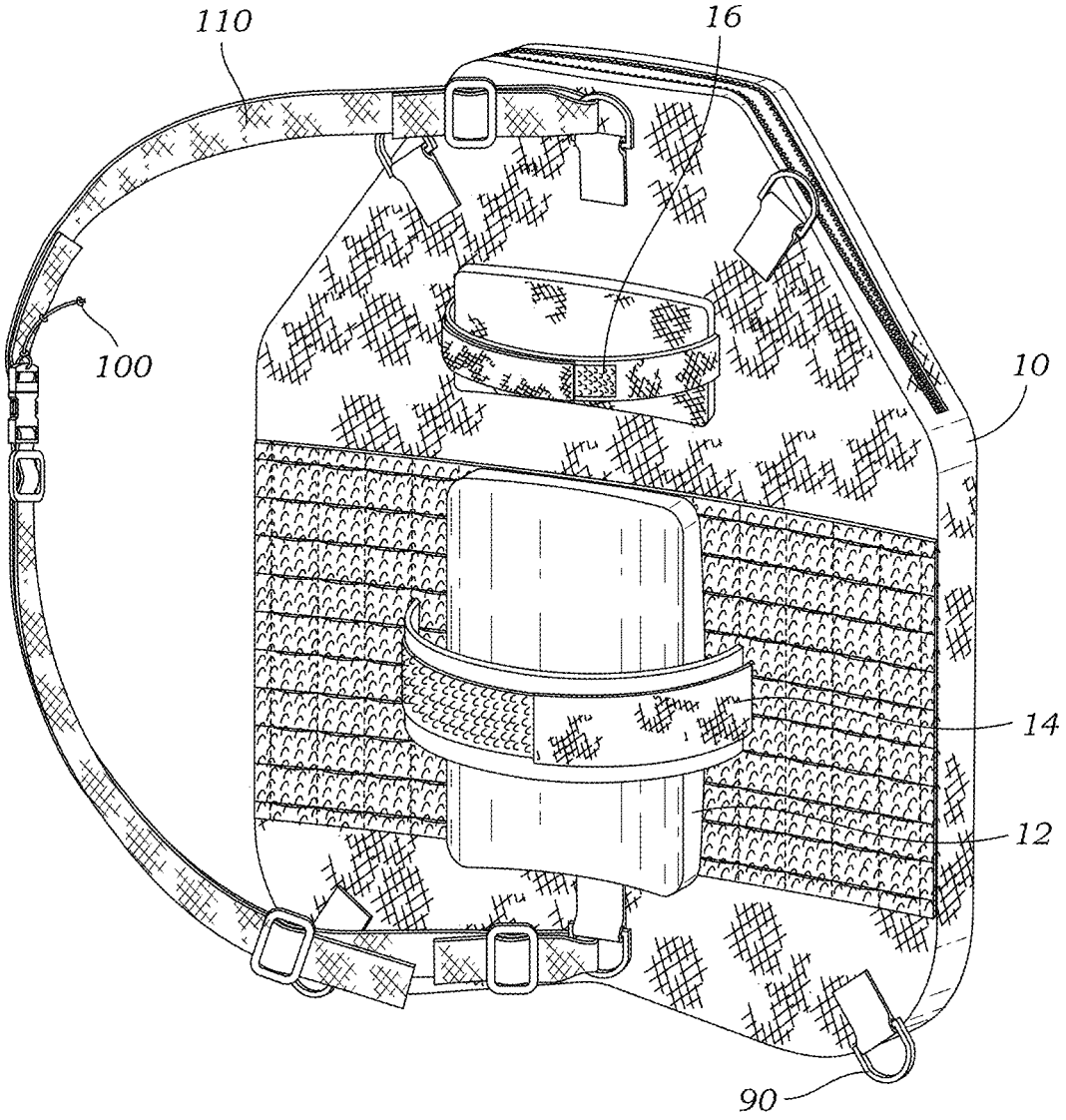
FIG. 26 is a back perspective view of the LOAD BEARING SHIELD COVER having a quick adjustment string with a buckle strap for quickly adjusting the length of the strap that is placed on a user's shoulder.
Figure 27:
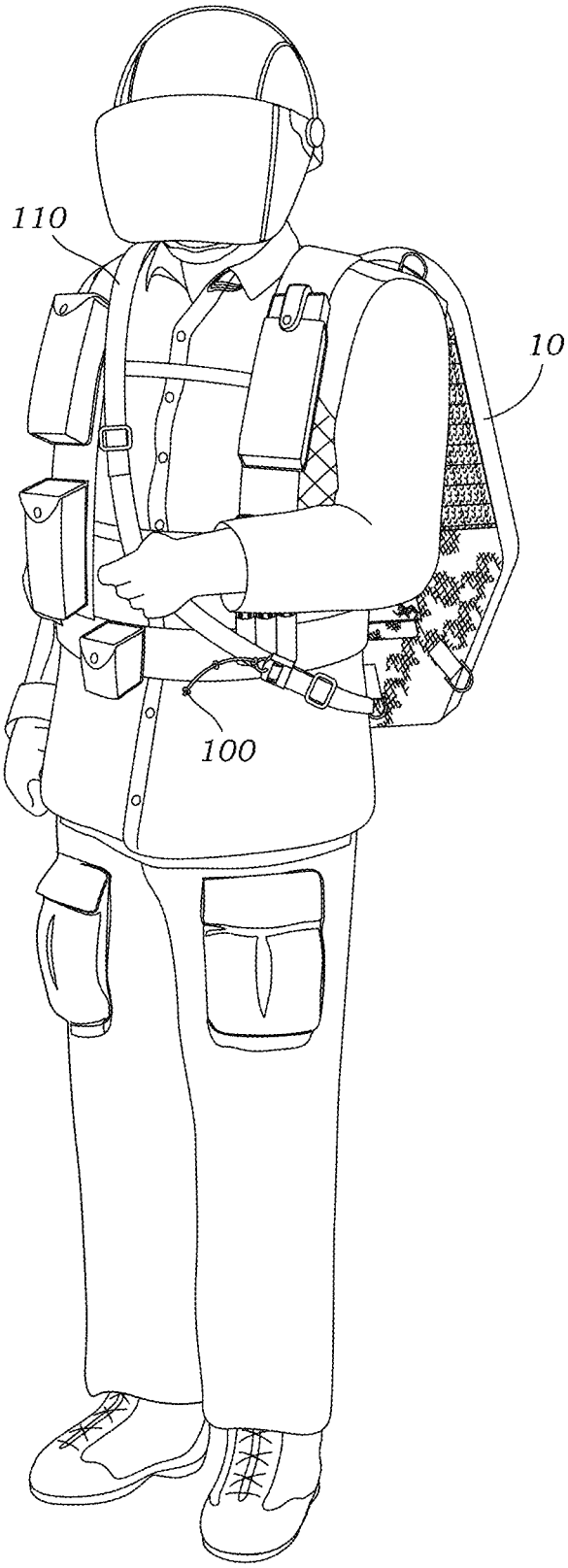
FIG. 27 is a front perspective view of the LOAD BEARING SHIELD COVER having a quick adjustment string with a buckle strap for quickly adjusting the length of the strap that is placed on a user's shoulder who is wearing it backpack style.
Figure 28:
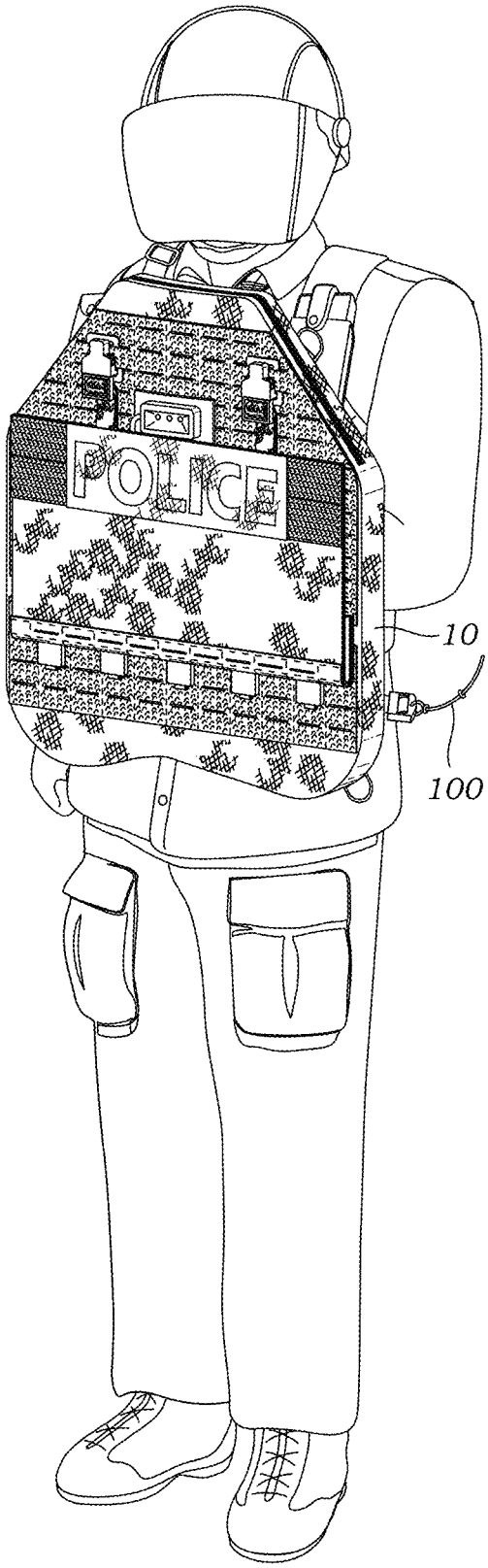
FIG. 28 is a front perspective view of the LOAD BEARING SHIELD COVER having a quick adjustment string with a buckle strap for quickly adjusting the length of the strap that is placed on a user's shoulder who is wearing it to cover the chest of said user.
Figure 29:
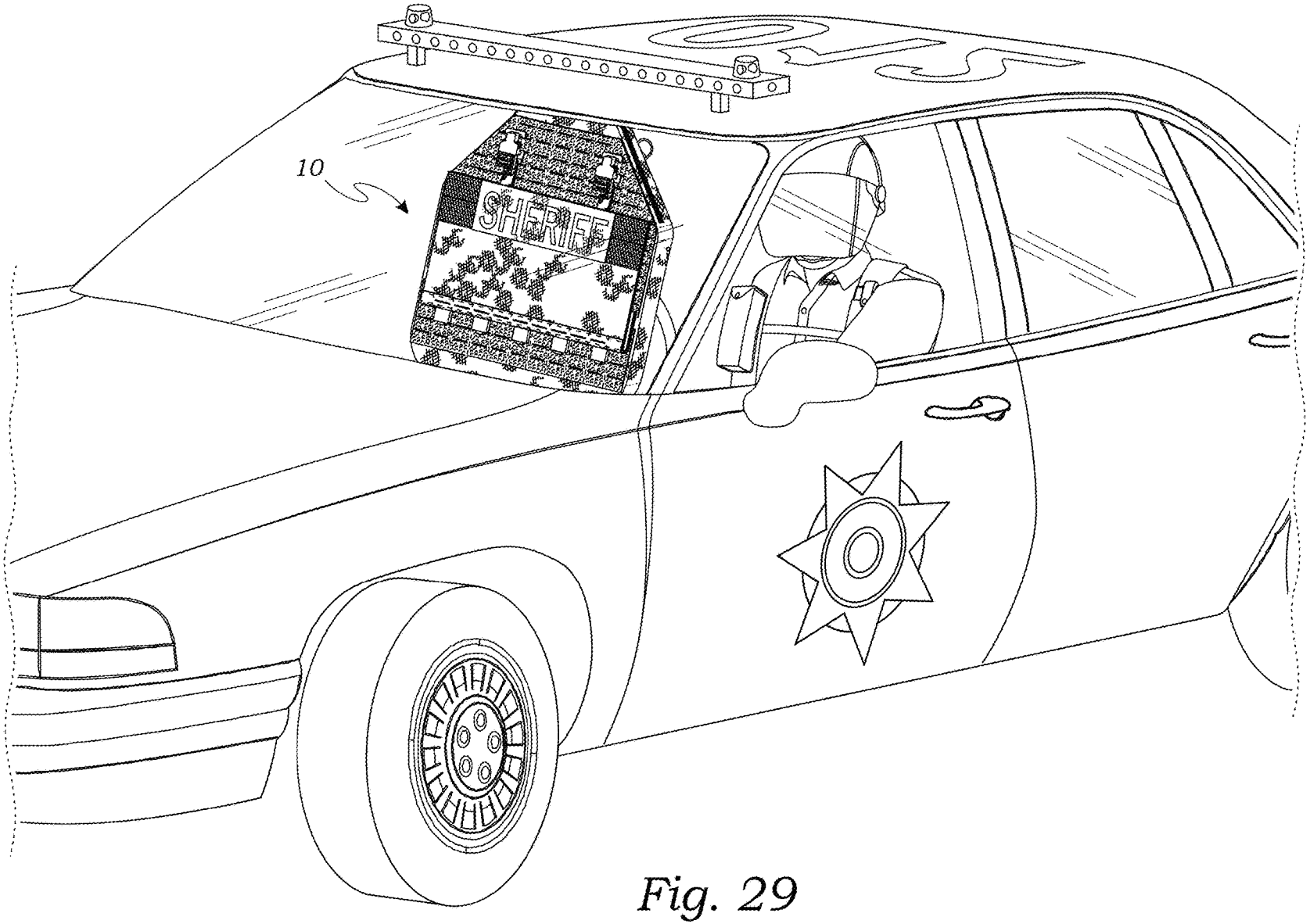
FIG. 29 is a perspective view of the LOAD BEARING SHIELD COVER having the DROP DOWN SHIELD COVER EXPANSION positioned in the front window of a police car.
Figure 30:
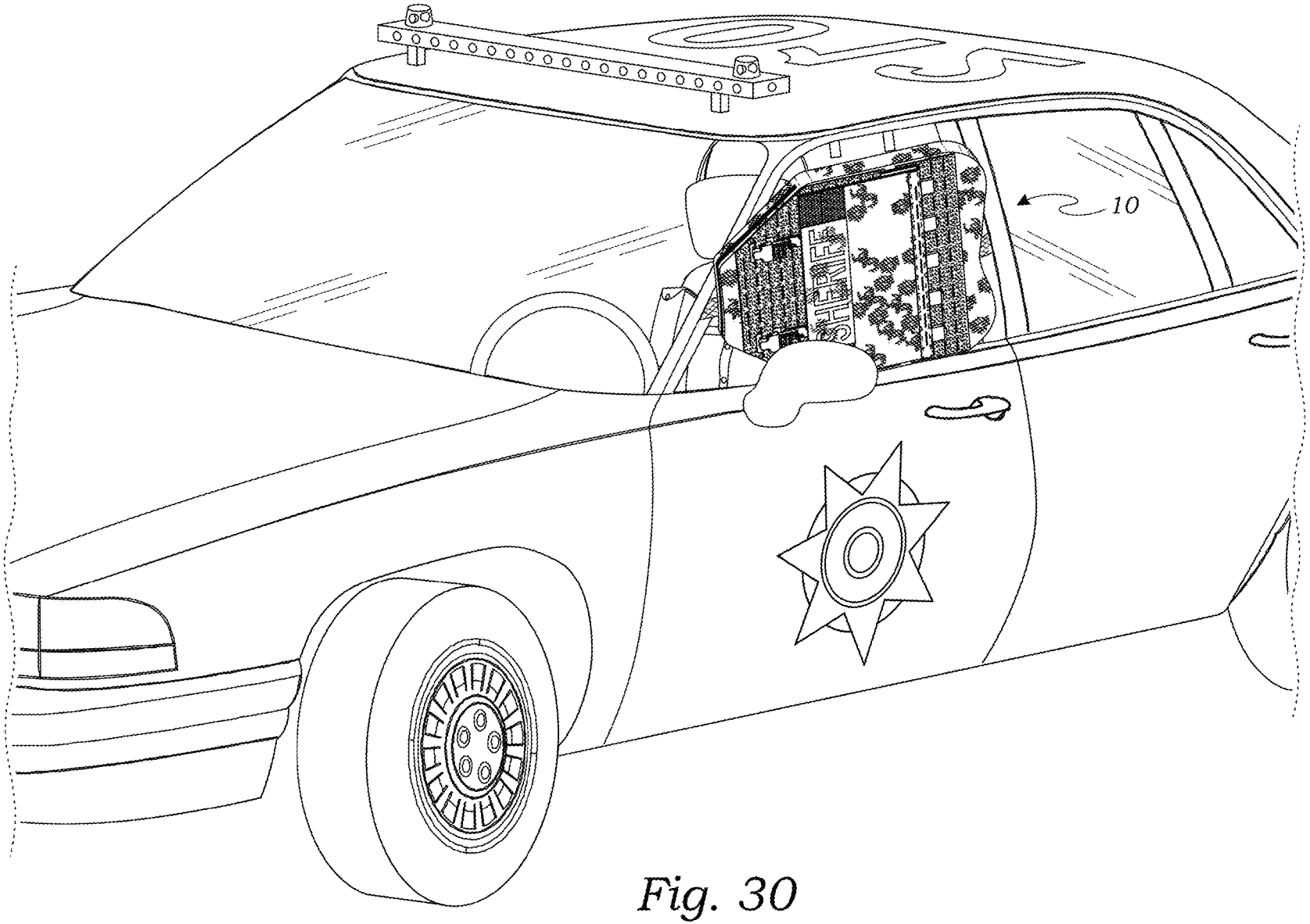
FIG. 30 is a perspective view of the LOAD BEARING SHIELD COVER having the DROP DOWN SHIELD COVER EXPANSION positioned in the side window of a police car.

Referring to FIGS. 26-28 showing the invention, a load bearing shield cover having a quick release string with a buckle strap for placing on a person's shoulder. Wherein the quick adjustment string with a buckle strap is positioned on a person's shoulder who is wearing it backpack style with the cover positioned against a user's back. Wherein the quick adjustment string with a buckle strap is positioned on a person's shoulder who is wearing it to cover the chest of a user.

Originally designed for solo officer responses to active shooter incidents, this lightweight and compact shield can be quickly deployed from the front seat of a patrol vehicle for a variety of response options. Where time is critical and immediate engagement of a lethal threat is necessary to interrupt and stop the killing, Compact Response Shield (CRS) can provide the first responder with a high degree of confidence by expanding the degree of ballistic protection, and by providing added coverage at angles not obtainable from standard plate carriers alone. The design and utility of this shield allows for excellent and accurate use of both rifle and pistol weapon platforms. In addition, the molle, Velcro and D-rings on the load bearing shield cover allow for the attachment of accessories such as medical kits, tourniquets, lights, slings, ammo pouches, etc. Due to its modular design, two shields can be connected at the bottom D-rings (one inverted) to provide more cover if desired.

The load bearing shield cover is made in the USA from 1000 Denier Nylon. With Mil-Spec webbing and stitching. This high-quality cover was designed to be durable and resilient. The cover features front padding, Molle webbing, replaceable high impact forearm padding, forearm strap, and adjustable integrated handle. Customize your shield by mounting various pouches, equipment and accessories. The top loading YKK zipper system secures your ballistic panel in place and allows for panel or cover swap if desired.

The new Kydex Rifle Support Bracket is made in the USA and has been designed specifically for the CRS. It is mounted to the front Molle of the cover and can be placed on either the left or right side depending on the user. The support bracket is large enough to accommodate most rifle fore-grips and creates a steady platform for shooting while still allowing for proper sight picture.

The optional Foxfury Taker B30 600 Lumen shield light can be easily mounted on the shield cover and comes with 3 lighting modes (including strobe) by activation of the pressure switch. The optional bungee sling is made in the USA and is attached to the cover via the D-rings and sling clips. This sling can also be adjusted pulling on the sling loop. Use your own sling if desired.

A portable bullet-proof shield 200 comprising a load bearing shield cover 10 for integrating a bullet resistant ballistic protective shield 20; said bullet resistant ballistic protective shield 20 has no bolts, screws, or holes drilled into the ballistic protective shield, thereby not compromising the integrity of said bullet resistant ballistic protective 20; said load bearing shield cover 10 has a high impact forearm padding 12, a forearm strap 14, and an integrated adjustable handle 16, which is intended to reduce fatigued and increase mobility of a user 300; one or more clamping support clips 30 that are interwoven into a webbing 35 on said load bearing shield cover 10 to provide clamping support for connecting a drop-down shield cover 40 to said load bearing shield cover 10; said drop-down shield cover 40 contains a bullet resistant insert 50; said load bearing shield cover 10 has one or more release buckles 60 for connecting to said drop-down shield cover 40 containing said bullet resistant insert 50; said release buckles 60 on said load bearing shield cover 10 are designed to hold up the drop down shield cover 40, when it is not expanded or in use; and said drop-down shield cover 40 will provide further bullet resistant protection beyond the size of said load bearing shield cover to then drop down and protect the lower area of said user's body.

The portable bullet-proof shield, further comprising a rifle support bracket 70 having two connector pieces, a back connector piece 74 which is interwoven into said webbing 35 on said load bearing shield cover 10 and a front connector piece 76 which is also interwoven into said webbing 35 on said load bearing shield cover 10 and one or more screw 78 to hold the two connect pieces together.

The portable bullet-proof shield wherein said bullet resistant ballistic protective shield 20 having no bolts, screws, or holes drilled into the ballistic protective shield is curved.

Wherein said load bearing shield cover 10 further comprises a webbing 35 consists of one or more horizontal rows of straps, spaced apart, and sewn to the backing at various intervals.

Wherein said load bearing shield cover 10 utilizes an inside strap 80 positioned inside said load bearing shield cover 10 to lock into place said bullet resistant ballistic protective shield 20.

Further comprising one or more D rings connectors for connecting to said load bearing shield cover 10, so said user can connect two load bearing shield covers 10 together, by connecting the two D-rings 90 together from the bottom of each load bearing shield cover and inverting the bottom of said load bearing shield cover to provide more protection.

Further comprising a quick adjustment string 100 connected to a buckle strap 110 for quickly adjusting the length of said buckle strap 110 that is placed on a user's shoulder for holding and connecting to said load bearing shield cover 10.

A portable bullet-proof shield comprising: a load bearing shield cover for integrating a bolt free bullet resistant ballistic protective shield; said load bearing shield cover utilizes a strap inside said cover to lock into place said bullet resistant ballistic protective shield; and said bullet resistant ballistic protective shield has no bolts, screws, or holes drilled into the ballistic protective shield, thereby not compromising the integrity of the shield.

Wherein said load bearing shield cover has a front padding, a high impact forearm padding, a forearm strap, and an integrated adjustable handle, which is intended to reduce fatigued and increase mobility of a user.

Further comprising one or more clips that are interwoven into said load bearing shield cover to provide clamping support for connecting a drop-down shield cover to said load bearing shield cover.

Wherein said load bearing shield cover connected to said drop-down shield cover contains a bullet resistant insert.

Further comprising one or more release buckle on said load bearing shield cover, which is designed to hold up the drop down shield cover, when it is not expanded or in use.

Wherein said drop-down shield cover will provide further bullet resistant protection beyond the size of said load bearing shield cover to then drop down and protect the lower area of a user's body.

Further comprising a rifle support bracket having two connector pieces, a back connector piece which is interwoven into said load bearing shield cover and a front connector piece which is also interwoven into said load bearing shield cover and one or more screw to hold the two connect pieces together.

Further comprising a quick adjustment string with a buckle strap for quickly adjusting the length of a strap that is placed on a user's shoulder for holding and connecting to said load bearing shield cover.

A portable bullet-proof shield comprising a load bearing shield cover for integrating a bolt free bullet resistant ballistic protective shield; said bullet resistant ballistic protective shield has no bolts, screws, or holes drilled into the ballistic protective shield, thereby not compromising the integrity of the shield; said load bearing shield cover has a high impact forearm padding, a forearm strap, and an integrated adjustable handle, which is intended to reduce fatigued and increase mobility of a user; and a rifle support bracket having two connector pieces, a back connector piece which is interwoven into said load bearing shield cover and a front connector piece which is also interwoven into said load bearing shield cover and one or more screw to hold the two connect pieces together.

Further comprising one or more clips that are interwoven into said load bearing shield cover to provide clamping support for connecting a drop-down shield cover to said load bearing shield cover.

Wherein said load bearing shield cover connected to said drop-down shield cover contains a bullet resistant insert;

Further comprising a dual release buckle on said load bearing shield cover is designed to hold up the drop down shield cover, when it is not expanded or in use.

Wherein said drop-down shield cover will provide further bullet resistant protection beyond the size of said load bearing shield cover to then drop down and protect the lower area of a user's body.

Further comprising a quick adjustment string with a buckle strap for quickly adjusting the length of a strap that is placed on a user's shoulder for holding and connecting to said load bearing shield cover.

While the description above refers to a particular embodiment of the present invention, it will be understood that many modifications may be made without departing from the spirit thereof. The presently disclosed embodiments are therefore to be considered in all respects as illustrative and not restrictive.

I claim:

1. A portable ballistic-resistant shield comprising:

a load-bearing support system having a frame that defines a perimeter configured to receive and engage at least a portion of a removable ballistic-resistant panel; and a compression system coupled to the load-bearing support system and configured to apply inward compression that resists the panel displacing from an installed position at the perimeter.

2. The portable ballistic-resistant of claim 1, wherein the frame includes opposed frame segments configured to cooperatively engage the panel.

3. The portable ballistic-resistant shield of claim 2, wherein the opposed frame segments are configured to at least partially separate from one another.

4. The portable ballistic-resistant bullet-proof shield of claim 1, wherein the compression system has a compression element configured to be disposed around an external perimeter of the panel.

5. The portable ballistic-resistant shield of claim 4, wherein the compression element is a strap.

6. The portable ballistic-resistant bullet proof shield of claim 1, further comprising a locking arrangement integrated with the compression system and configured to selectively lock the panel in the installed position at the perimeter and release the panel for replacement.

7. The portable ballistic-resistant shield of claim 1, wherein the removable ballistic-resistant panel has an imperforate, monolithic, unitary body having a continuous surface and the panel is configured to provide ballistic protection meeting or exceeding National Institute of Justice (NIJ) Standard 0101.07 threat levels HG2 (handgun, formerly Level IIIA) and RF1 (rifle, formerly Level III).

8. The portable ballistic-resistant shield of claim 1, wherein the load-bearing support system provides distributed load-bearing support to the panel.

9. The portable ballistic-resistant shield of claim 1, wherein the load-bearing support system is configured to fully enclose the panel when the panel is installed at the installed position at the perimeter.

10. The portable ballistic-resistant shield of claim 1, wherein the load-bearing support system has a forearm strap including high impact forearm padding.

11. The portable ballistic-resistant shield of claim 1, wherein the load-bearing support system includes a bracket coupler configured to couple to a firearm support bracket.

* * * * *